US005434661A

United States Patent [19]

Takahashi et al.

[11] Patent Number: 5,434,661

[45] Date of Patent: Jul. 18, 1995

[54] SHEET POST-PROCESSING APPARATUS INCLUDING OFFSET MEANS FOR SELECTIVELY OFFSETTING SHEETS DISCHARGED IN ONE OF PLURAL BINS RELATIVE TO SHEETS DISCHARGED IN THE OTHER OF SAID PLURAL BINS

[75] Inventors: Yuji Takahashi, Tokyo; Masakazu Hiroi, Yokohama, both of Japan

[73] Assignee: Canon Kabushiki Kaisha, Tokyo, Japan

[21] Appl. No.: 117,349

[22] Filed: Sep. 7, 1993

Related U.S. Application Data

[63] Continuation of Ser. No. 882,419, May 13, 1992, abandoned.

[30] Foreign Application Priority Data

May 14, 1991 [JP] Japan ..... 3-109224

[51] Int. Cl.[6] ..... G03G 21/00; B65H 29/00

[52] U.S. Cl. ..... 355/322; 271/286; 355/324; 270/53

[58] Field of Search ..... 355/224, 321, 318, 319, 355/323, 322; 271/287, 288, 292, 294, 285, 286; 270/53

[56] References Cited

U.S. PATENT DOCUMENTS

| | | | |
|---|---|---|---|
| 4,141,546 | 2/1979 | Queener | 271/173 |
| 4,229,650 | 10/1980 | Takahashi et al. | 250/223 |
| 4,511,297 | 4/1985 | Wilson et al. . | |
| 4,883,265 | 11/1989 | Iida et al. | 271/220 |
| 4,925,171 | 5/1990 | Kramer et al. | 271/293 X |
| 4,965,629 | 10/1990 | Hiroi et al. | 355/324 X |
| 5,032,876 | 7/1991 | Murakami | 355/324 |
| 5,104,106 | 4/1992 | Shido et al. | 270/53 |

FOREIGN PATENT DOCUMENTS

| | | |
|---|---|---|
| 60-102364 | 6/1985 | Japan . |
| 64-002975 | 1/1989 | Japan . |
| 2-262288 | 10/1990 | Japan . |

*Primary Examiner*—R. L. Moses

*Attorney, Agent, or Firm*—Fitzpatrick, Cella, Harper & Scinto

[57] ABSTRACT

A sheet post-processing apparatus includes plural bins positioned at predetermined intervals for accommodating discharge sheets, and a sheet discharger for discharging the sheets into the bins. An offset device is provided for selectively offsetting the sheets in one of the bins to a second aligning position which is different from a first aligning position to which the sheets are discharged by the sheet discharger, and a controller is provided for selectively operating the offset device.

23 Claims, 24 Drawing Sheets

SHEET POST-PROCESSING APPARATUS INCLUDING OFFSET MEANS FOR SELECTIVELY OFFSETTING SHEETS DISCHARGED IN ONE OF PLURAL BINS RELATIVE TO SHEETS DISCHARGED IN THE OTHER OF SAID PLURAL BINS

This application is a continuation of U.S. application Ser. No. 07/882,419 filed May 13, 1992, now abandoned.

FIELD OF THE INVENTION AND RELATED ART

The present invention relates to a sheet post-processing apparatus and, in particular to a sheet post-processing apparatus for sorting and stacking sheet materials (hereinafter, called sheet) such as copy paper, transfer paper or recording paper, which is discharged from a copying machine, printer, or other recording machine, for example, more particularly to a sheet post-processing apparatus with functions for sorting, aligning, and/or stapling the sheets.

Conventionally, a shifting bin type sorter is configured in such a manner that each of the bins in the bin unit is sequentially positioned at the discharge outlet while a given number of sheets are discharged, that is, after a predetermined number of sheets are discharged into the preceding bin, the succeeding bin is shifted up or down to sort the sheets.

The bin is set to make the bin interval open wider at the position facing the sheet discharge outlet, so that the latitude is wider for accommodating the sheets which may be curling upward or downward, when the sheets are discharged.

Further, in order to save space and to place more bins, the intervals between the bins which are not facing the sheet discharge opening are made narrower than those facing the outlet (generally speaking, it is configured to obtain the most appropriate interval for stacking the maximum number of sheets per bin of the sheet post-processing apparatus).

As a result, the optimum sorter size is one with specifications that allowed the placement of 20 to 25 bins per bin unit, with a bin capacity to hold 50 sheets per bin (in consideration of the sorter's appearance integrated with the copy machine assembly, and the operational efficiency when the sheets are taken out).

Therefore, the relation between the number of sheets and the number of bins is generally set up in such a manner that an attempt to increase the sheet capacity per bin reduced the number of bins, and an attempt to increase the number of bins reduces the sheet capacity per bin.

However, in the prior example, the intervals between respective bins are insufficiently set up (this does not mean that there are problems when the maximum number of sheets are stacked) in order to improve the optimum sorter specifications (improvement of maximum sortable number of pages), and even if the maximum stackable number of sheets can be sorted and stacked in each bin, the breaks between the respective stacks of sheets are extremely difficult to find when the user is taking the copy sheet stacks out of the bins after the above mentioned processing. In particular, if the stacks are non-stapled ones, the sheet stacks in the adjacent bin may be sometimes mistakenly taken out together, making it necessary to perform annoying operations such as re-sorting them manually.

Further, even if the user tries to take the sheet stacks out one by one sequentially from each bin, it is extremely difficult to take them out, since the sheet stacks are placed on top of each other in a straight line, making the fingering spaces themselves diminish by the pressure caused by the weight of the sheets themselves when the sheets are almost fully stacked.

SUMMARY OF THE INVENTION

The present invention has been made in view of the faults of the above mentioned prior apparatus, and its object is to provide a sheet post-processing apparatus which facilitates easy removal of the sheet stacks.

In order to accomplish the above mentioned object, the present invention includes the feature that the sheet stacks are alternately shifted in the lateral (or longitudinal) direction, making it easier to remove individually each of the sheet stacks.

According to the present invention, a shifting means is prepared in such a manner that the position of the sheet stack in each bin can be optionally offset in the lateral direction, whereby the sheet stack in each bin can be offset as is shown in FIG. 18 to make it easier to see clearly the breaks between the individual sheet stacks in the respective bins. As a result, even when extra sheet stacks in the adjacent bins are mistakenly removed along with the correct one, the breaks can be clearly seen, thereby eliminating the need for repeated sorting. Also, the operational efficiency is improved with the elimination of such a problem that it becomes difficult to remove the sheet stacks since the bins loaded with almost fully stacked sheets alloys the intervals to change between the sheet stacks in the respective bins, thereby preventing the fingers from being inserted there.

In addition, since all of the sheet stacks are offset as is shown by the preferred embodiment of the present invention, as many sheet stacks as can be possibly grasped with use of both hands can be removed all at once, whereby operational efficiency can be drastically improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
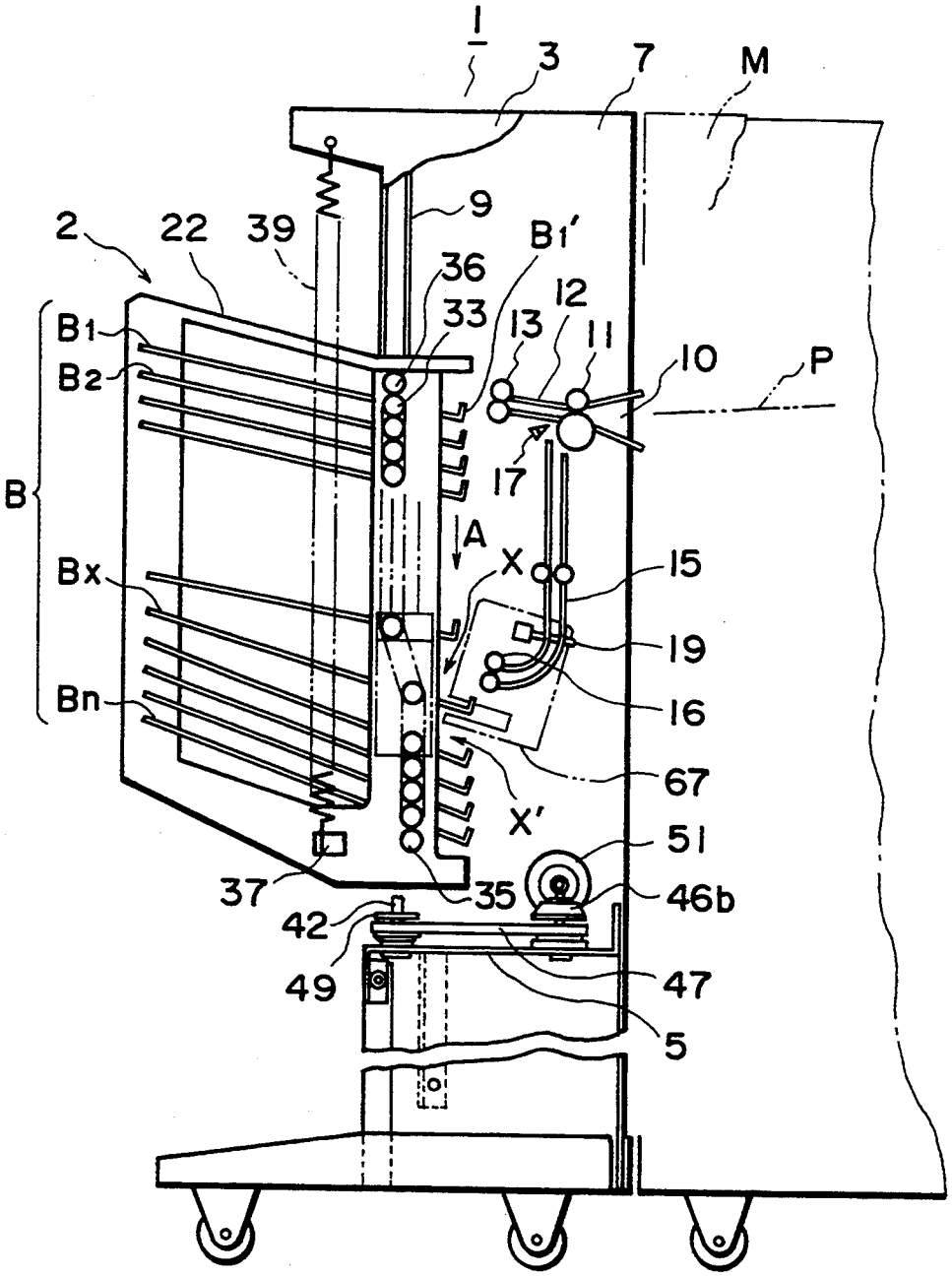
FIG. 1 is a longitudinal sectional view showing a preferred embodiment of the present invention.

A preferred embodiment of the present invention will explained, referring to the drawings.

FIG. 1 is a sectional view showing the general arrangement of an apparatus in accordance with the present invention, and the explanation is going to be simplified since its basic operational configuration had been already explained in Japanese Patent Publication No. HEI 2-262288 (Sep. 29, 1990) and such.

Figure 3:
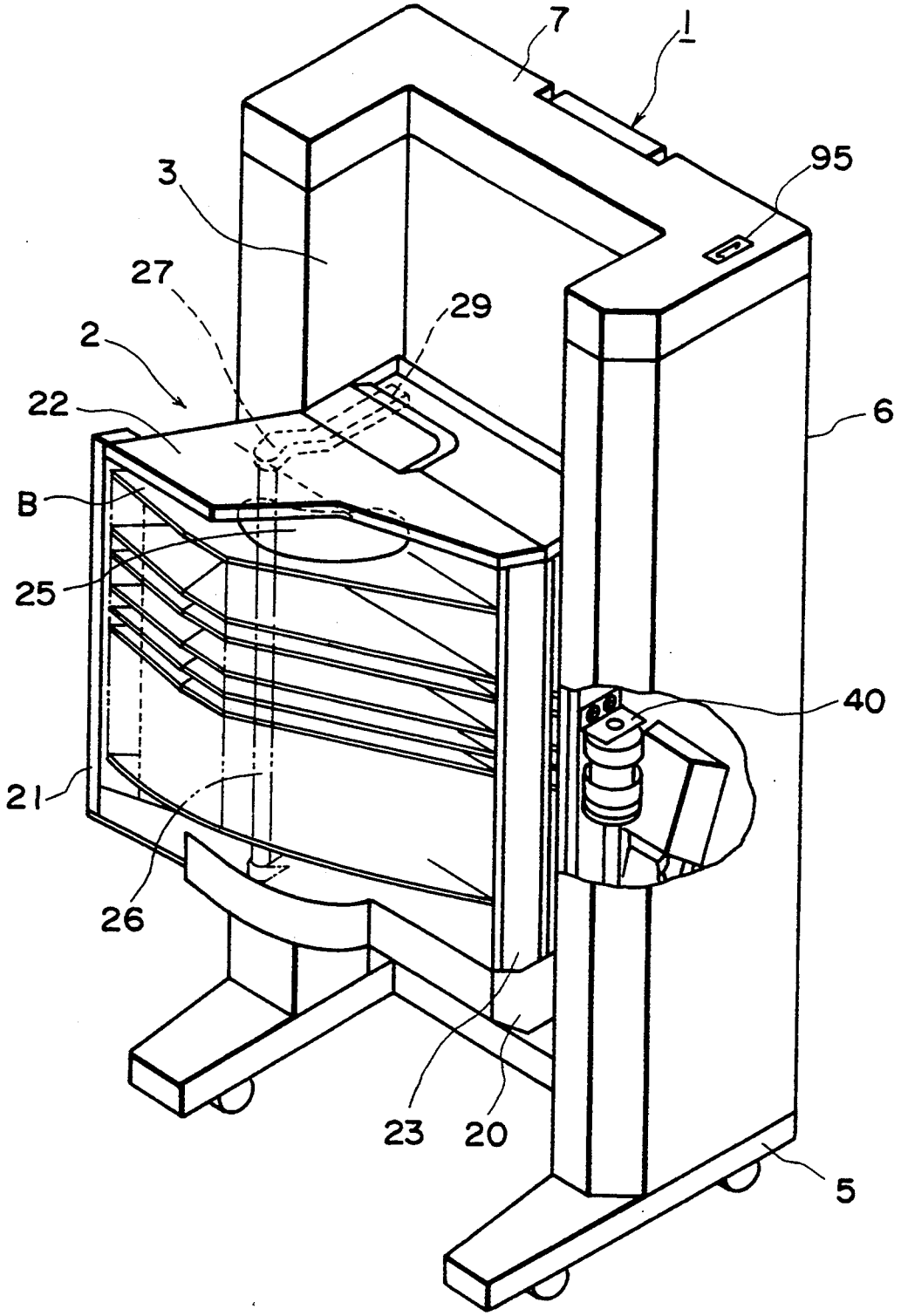
FIG. 3 is a perspective view of the sheet post-processing apparatus.

In FIGS. 1 and 3, movable bin type sorter 1 (sheet post-processing apparatus) is provided with a sorter main assembly 7 consisting of a pair of left and right side plates 3, a base 5, a cover 6, and the like. This sorter 1 is equipped with the bin unit 2, which stores bins B consistituting of a group of multiple bins $B_1$–$B_n$ and can be moved up and down along a pair of guide rails 9 provided on the above mentioned respective side plates 3.

The sorter main assembly 7 is coupled with an image forming apparatus M (comprising a photosensitive drum, transferring means, fixing means, discharge roller, cassette, image reading means, original script delivery means and such) placed on its upstream side (right side in FIG. 1), and is provided with inlet 10 for accommodating the sheets P discharged from the image forming apparatus and a pair of receiving rollers 11. First sheet conveying passage 12 which extends from the above mentioned pair of receiving rollers 11 toward the bin unit 2 is provided, along with upper discharge rollers 13, and also, second sheet conveying passage 15 which branches downward from this upper discharge rollers 13 is provided, along with a pair of lower discharge rollers 16 (sheet discharge means), respectively. At the branching point of the above described two sheet conveying passages 12 and 15, a deflector 17 is provided, which is selectively displaced to guide into the first conveying passage 12 the sheets to be discharged into the bin B from upper rollers 13 or into second conveying passage 15 the sheets to be discharged into the bin B from lower discharge rollers 16.

Sheet sensor 19 for detecting the presence of the sheet P is provided adjacent to the sheet discharging area of the above mentioned second sheet delivery passage 15, and in the case of this embodiment, this sheet sensor 19 consists of a reed switch with a built-in photointerruptor, but a transmission type sensor may be used to obtain the same function. The presence of the sheet P discharged from image forming apparatus M is also detected by the discharge sensor of the image forming apparatus, which is provided within this apparatus, and in the case of this embodiment, it is also possible to measure the time it takes for the sheet P to pass and the interval between one sheet P and the following sheet P (sheet interval), whereby the discharge signal of the sheet P and the sheet interval signal are sent out from an arithmetic circuit integrated in the image forming apparatus itself, and are transmitted to a microcomputer within the bin unit 2.

Figure 2:
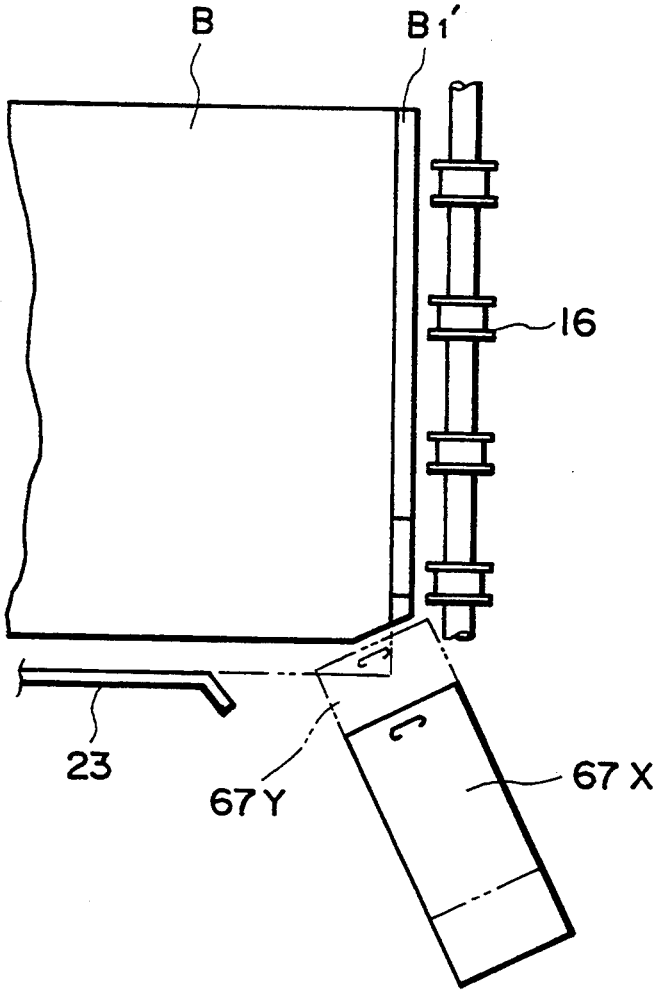
FIG. 2 is a sectional view of the same, from the direction indicated by arrow A in FIG. 1.

The bin unit 2, as is shown in FIGS. 1–3, has a pair of bin supporting plates 20 constituting a frame structure at the front and back. To the ends of this bin supporting plates 20, bin sliders 21 are mounted, and in addition, bin cover 22 is affixed to the bin supporting plates 20 and the bin sliders 21. Alignment reference wall 23, which extends from bin the cover 22 to the bin supporting plate 21, is affixed to this bin cover 22 and the bin supporting plate 20. Further, an alignment rod 26 is positioned perpendicularly across all of the bins B through recess 25 formed in each of bins B, and this alignment rod 26 is supported at its upper and lower ends by a pair of alignment arms 27 extending from center rod 29, whereby the alignment rod 26 can freely swing about center rod 29 the sheets P stacked in each of bins B are urged by the alignment rod 26 against alignment reference wall 23, thereby aligned.

Figure 4:
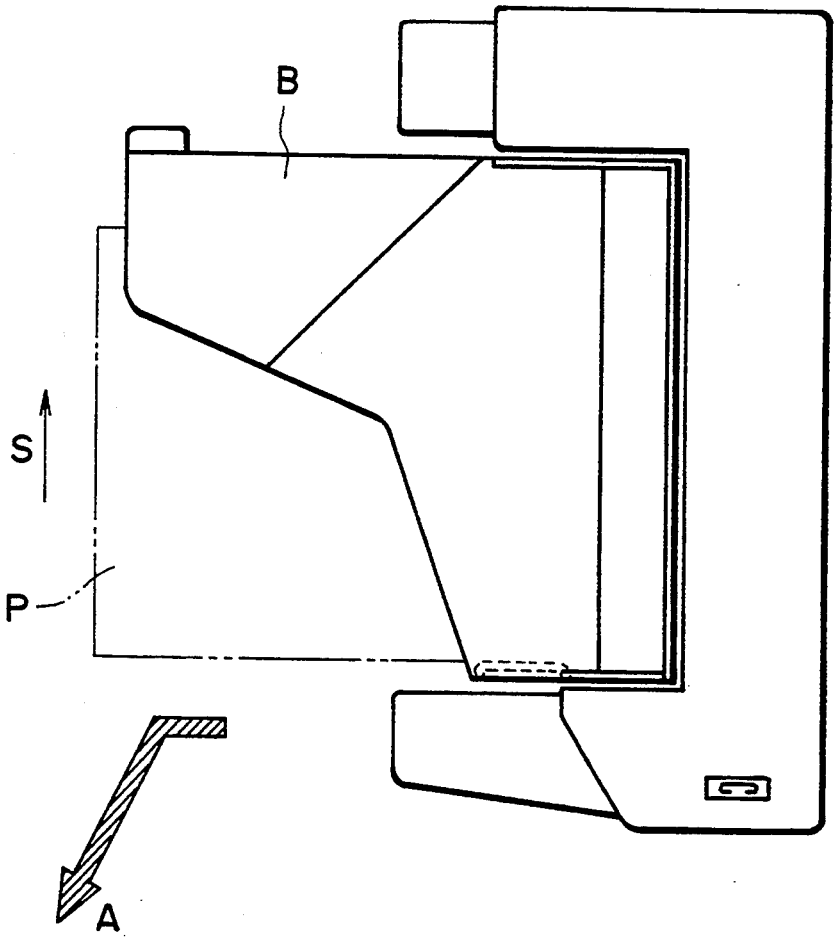
FIG. 4 is a top plan view of the same.
Figure 5A:
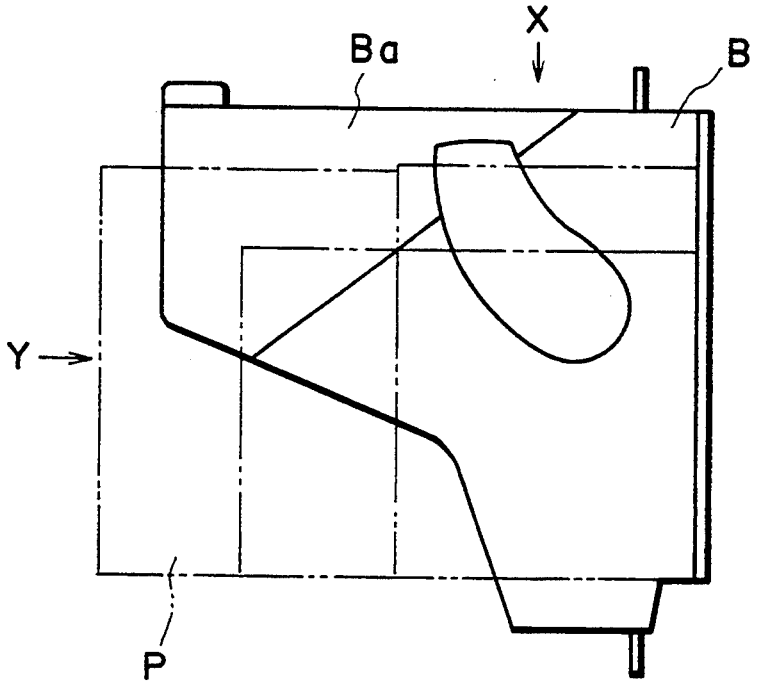
FIGS. 5A, 5B and 5C are plan views showing the details of the bin tray.
Figure 5B:
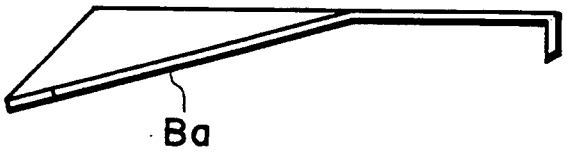
Figure 5C:
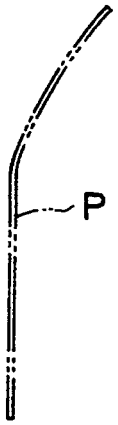

One of the characteristics of this embodiment is that the front side (side facing the viewer in FIGS. 3 and 6) of the bin slider 21, which supports the tail end of the bin, is cut out to give a space for free access. In addition, the bin B also is shaped as shown in FIG. 4 (top plane view of the apparatus), having an opening at the front side, thereby offering no support to the portion of the sheet P. However, since in order to give the sheet P longitudinal structural rigidity (increased resistance to bending), the bin B is bent slightly upward, as is shown in FIG. 5A, at side Ba which is opposite to the cutout section, and the sheets are prevented from drooping even at the section with no support by the bin. FIG. 5B is a side view of the bin B from the direction indicated by arrow X in FIG. 5A, and FIG. 5C the view from the direction indicated by arrow Y.

In this embodiment, since the shape of the bin and the bin unit are altered to give openings on one side, the sheet material can be removed from the front side of the bin (direction indicated by arrow A in FIG. 4), thereby the operational efficiency has been improved.

On the other hand, the free ends of the bin B placed within the bin unit 2 are movably rested in the respective bin grooves provided, looking like a set of comb teeth, on the inner walls of the bin sliders 21 (not illustrated).

Trunnions 33 which correspond to the respective bins B are fitted on top of each other within guide rail 9. The trunnion 33 at the lower end is in contact with lower guide roller 35 supported rotatively on the bin supporting plate 20, and the trunnion 33 at the upper end is in contact with the upper guide roller 36 also supported rotatively on the bin supporting plate 20. The respective bins B are held in the bin unit 2, with their intervals being kept equal to the external diameter of the trunnion 33.

As shown in FIG. 1, with the upper guide roller 36 and the lower guide roller 35 being fitted within guide rail 9, the bin unit 2 can climb up and down along guide rail 9. Incidentally, tension spring 39 is stretched between metal studs 37 fixed to the bin unit 2 and side plate 3, respectively, and its tension functions so as to pull the bin unit 2 upward.

Figure 8:
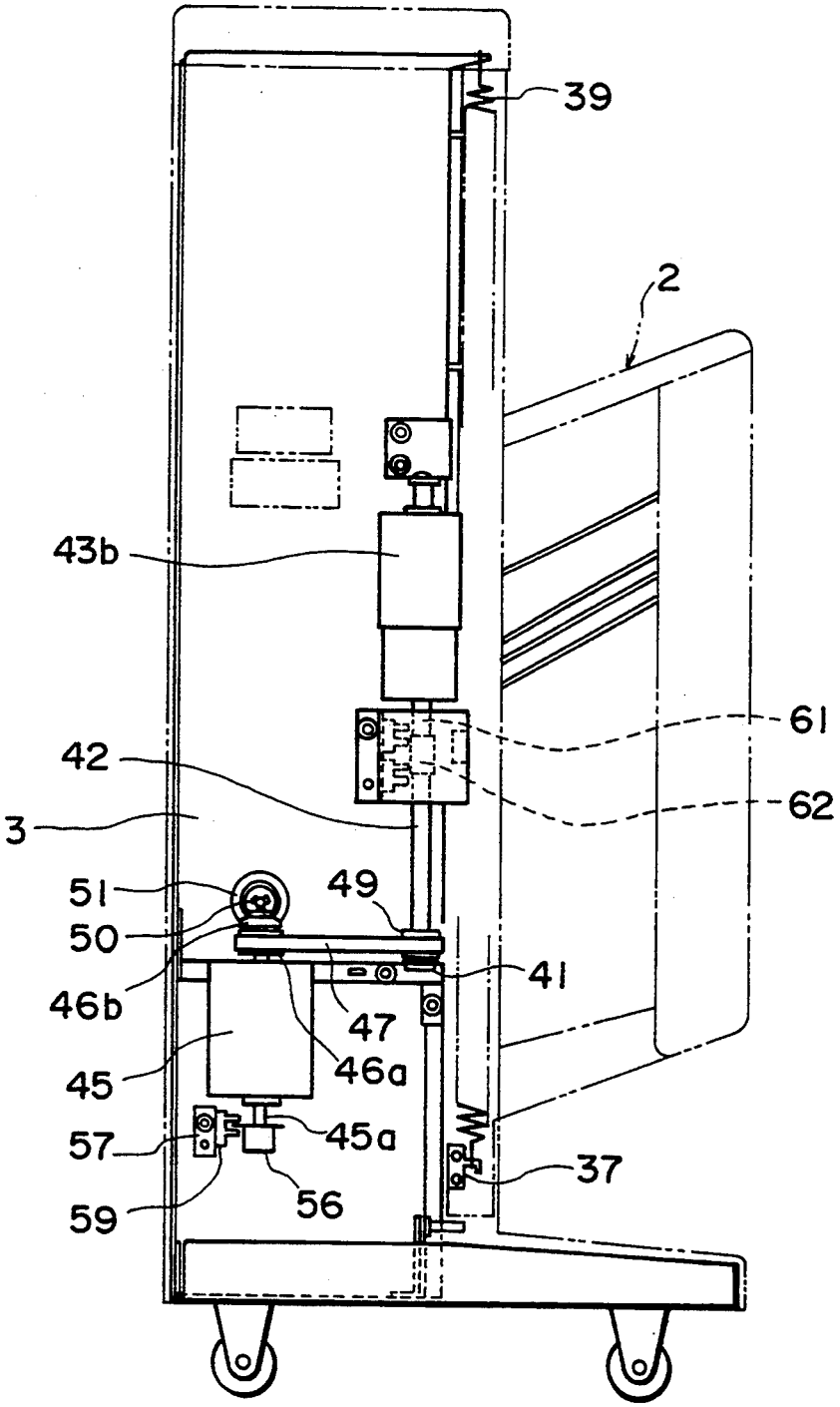
FIG. 8 is a cutaway view showing the internal structure of the opposite side of the apparatus in FIG. 1.

As shown in FIGS. 3 and 8, camshaft holder 40 is attached on each of the left and right side plates 3, at the location facing the pair of lower discharge rollers 16, and lead camshaft 42 supported by shaft bearing 41 is rotatively placed between this camshaft holder 40 and the above mentioned base plate 5. Also, the upper ends of left and right lead cams 42 are respectively provided with a pair of left and right lead cams 43*a* and 43*b* (helical cam means) having a helical cam surface.

Next, the stapler (sheet stapling mechanism) of this embodiment is explained in detail.

Figure 15:
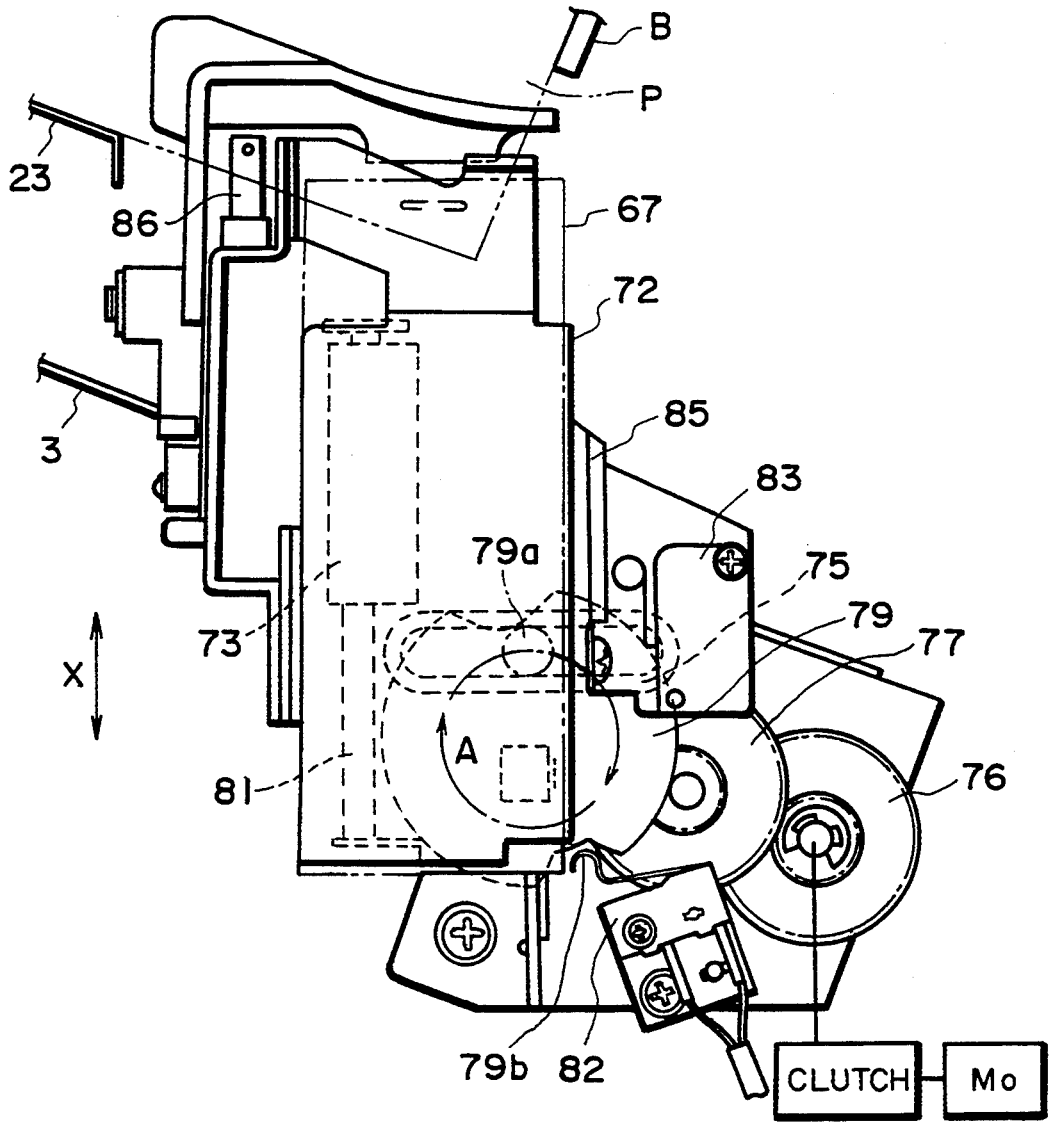
FIG. 15 is a plan view showing the sliding mechanism of the stapler.

FIG. 15 shows a plan view of the stapler. A sheet stapling mechanism (stapler) 67 is designated so as to be able to advance or retract relative to the bin B in sorter 1. This configuration is explained in more detail in FIGS. 15 and 16.

The stapler 67 indicated by the rectangle outlined by the two-dot chain line in the figure is an ordinary electric stapler, and comprises cartridge section 69 which can store a large number of staples, a hammer 67*b* which hammers down staples through the sheet P to perform the actual stapling function, and staple feeder 67*a* which sequentially feeds staples from staple cartridge 69 to stapling head opening 67*b*.

The stapler 67 can rotate about its rotational center 67*c*, and the hammer 67*b* of the upper unit of stapler 67 and anvil 67*b*' of the lower unit can sandwich (the upper unit can displace in the Y direction in FIG. 16) the sheet P to force down the staples. Also, a stapler cover 70 which covers the motor and the driving mechanism of the stapler (not illustrated) is attached with screws to stapler attachment metal plate 71. Stapler 67 itself is fixedly attached with screws to the above mentioned the stapler attachment metal plate 71.

The stapler attachment metal plate 71 is fixedly attached with screws to a movable table 72 which provides the reciprocating movement of the stapler 67. On the upper side of the movable table 72, a table guide 73 and a slider roller 75 are fixedly attached, and the driving force is delivered to ring gear 79 from stapler driving motor M0 by way of first gear 76 and second gear 77. Ring gear 79 has projection 79*a* which engages with the slider roller 75, and can rotate in the direction indicated by arrow A in the figure.

Two recesses are prepared on the opposing circumferential locations of the ring gear 79 to actuate microswitch 82 by actuator level 79*b*. As a one half rotation of the ring gear 79 makes projection 79*a* travel 180 degrees on its locus, the slider roller 75 can move the distance equal to the diameter of the locus of projection 79*a* of the ring gear 79. The above mentioned table guide 73 is engaged with guide shaft 81 to which stapler fixing metal plate 80 is attached, whereby movable table 72 on which the stapler 67 is mounted can translationally slide in the X direction as the ring gear 79 rotates.

Rotation detecting microswitch 82 detects every half rotation of the ring gear 79. Stapling unit position detecting microswitch 83 is engaged with cam 85 mounted on the side surface of movable table 72 so as to be off when the stapling unit is at retracted position 67X (FIG. 2) and to be on otherwise.

A transmission type sheet sensor which consists of the upper and lower protrusions forming a U-channel and which is capable of sensing the presence of the sheet P by the upper and lower protrusions is provided at one end of movable table 72, whereby the presence of the sheet P can be detected when the stapling unit reaches sheet stapling position 67Y (FIG. 2). The above mentioned stapling unit and the unit which provides the reciprocal movement of this stapling unit are fixedly attached to side plate 3.

Taper guide 87 is tapered at its tip on the sheet inlet side to prevent the tips of the sheets P from being turn back or dislocated as the stapling unit advances onto the sheets P (sheet stapling position 67Y). The guide 87 can rotate about rotational center 87*a*, and its trailing edge 87*b* is tensioned in the counterclockwise direction with an unshown spring means so as for stapler safety microswitch 89 to be on in the normal condition.

Therefore, for instance, when the stapling unit advances onto the sheet P (sheet stapling location 67Y) and a foreign object (for example, the operator's finger) or a stack of the sheets P whose thickness exceeds the stapling capacity of the stapler 67 is present in the bin B, moment is generated so as to push up the leading edge of the taper guide 87 since the bin B and lower taper guide 90 remain stationary, whereby the upper taper guide 87 rotates in the clockwise direction about rotational center 87*a*, turning safety microswitch 89 off to shut off the power supply to the stapler 67 by hardware.

Also, an interlock arm 91 having rotational center 91*a* is provided on top of the stapler cover 70. This interlock arm 91 is normally tensioned in the counterclockwise rotational direction by an unshown spring or the like.

Above the interlock arm 91, actuator plate 92 mounted on side plate 3 is provided. Regarding the reciprocating movement of the stapler unit in the X direction in FIG. 16, when the stapling unit is at the sheet stapling position 67Y in FIG. 2, the interlock arm 91 is at the location indicated by the solid line, and when the stapling unit is at retracted position 67X, the interlock arm 91 is in contact with the tip of actuator plate 92 and the lower section of the arm of the interlock arm 91 is rotated to be lowered to staple cartridge 69 of the stapler 67, as indicated by reference numeral 91*x*.

Next, the detection of the staple of the stapler 67 is explained.

Figure 16:
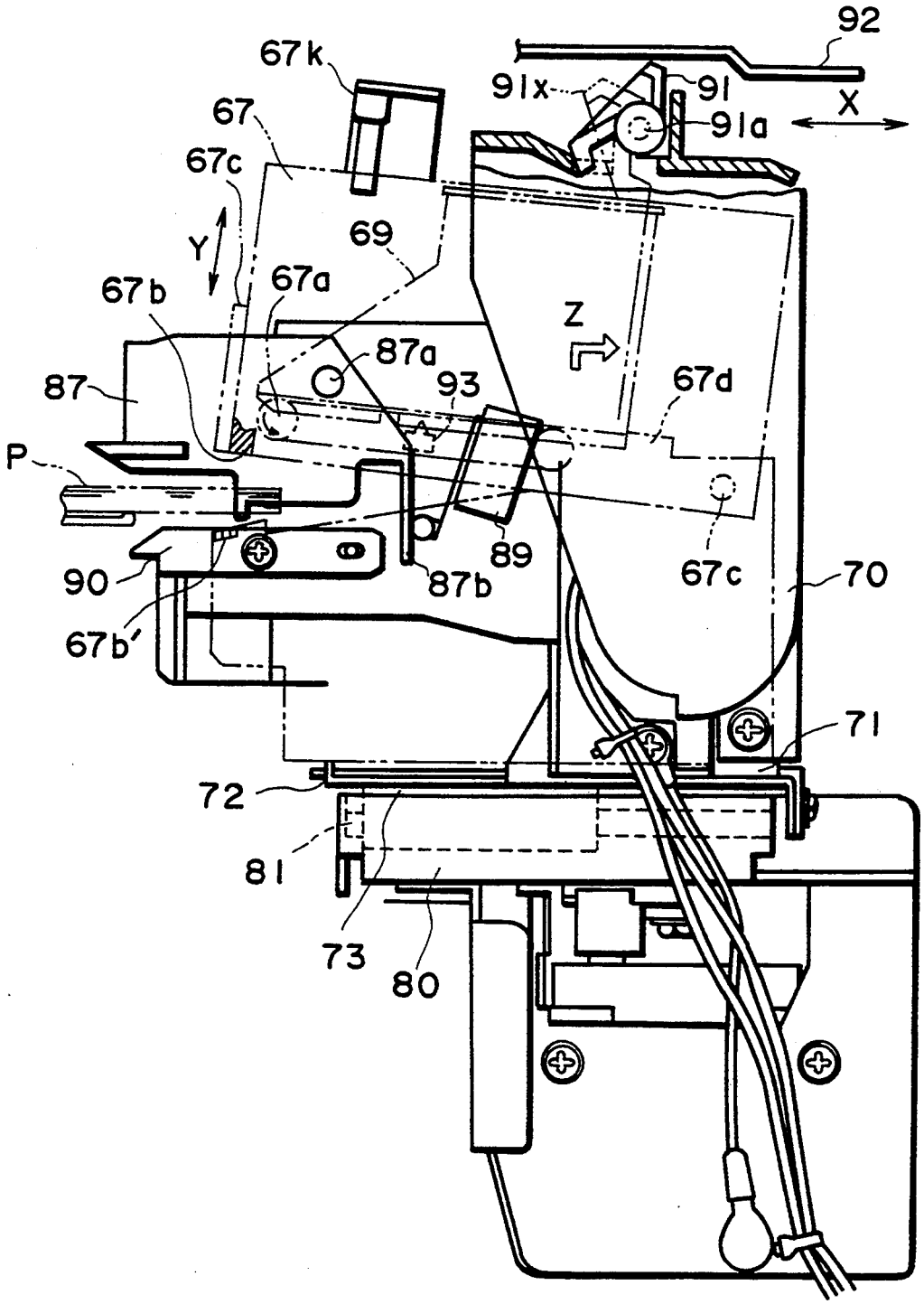
FIG. 16 is a plan view showing the mechanism for opening or closing the stapler.

In FIG. 16, the two-dot chain line indicated by reference numeral 93 represents a reflection type stapler sensor, which detects the absence of staples when the trailing end of the row of staples in a sheet form passes by reflection type staple sensor 92. At this time, a portion of the row of staples in a sheet form still remains on the upstream side of sensor 93, and the leading end is held on the side of the stapler 67. When the absence of the staples is detected, manual staple button 95 is flickered or a message indicating the absence of the staple is presented on the display screen of an unshown image forming apparatus (illustration omitted) to request replenishing the staples. Incidentally, in this embodiment, when the reflection type sensor 93 detects the absence of staples, stapling operation is prohibited.

Figure 11:
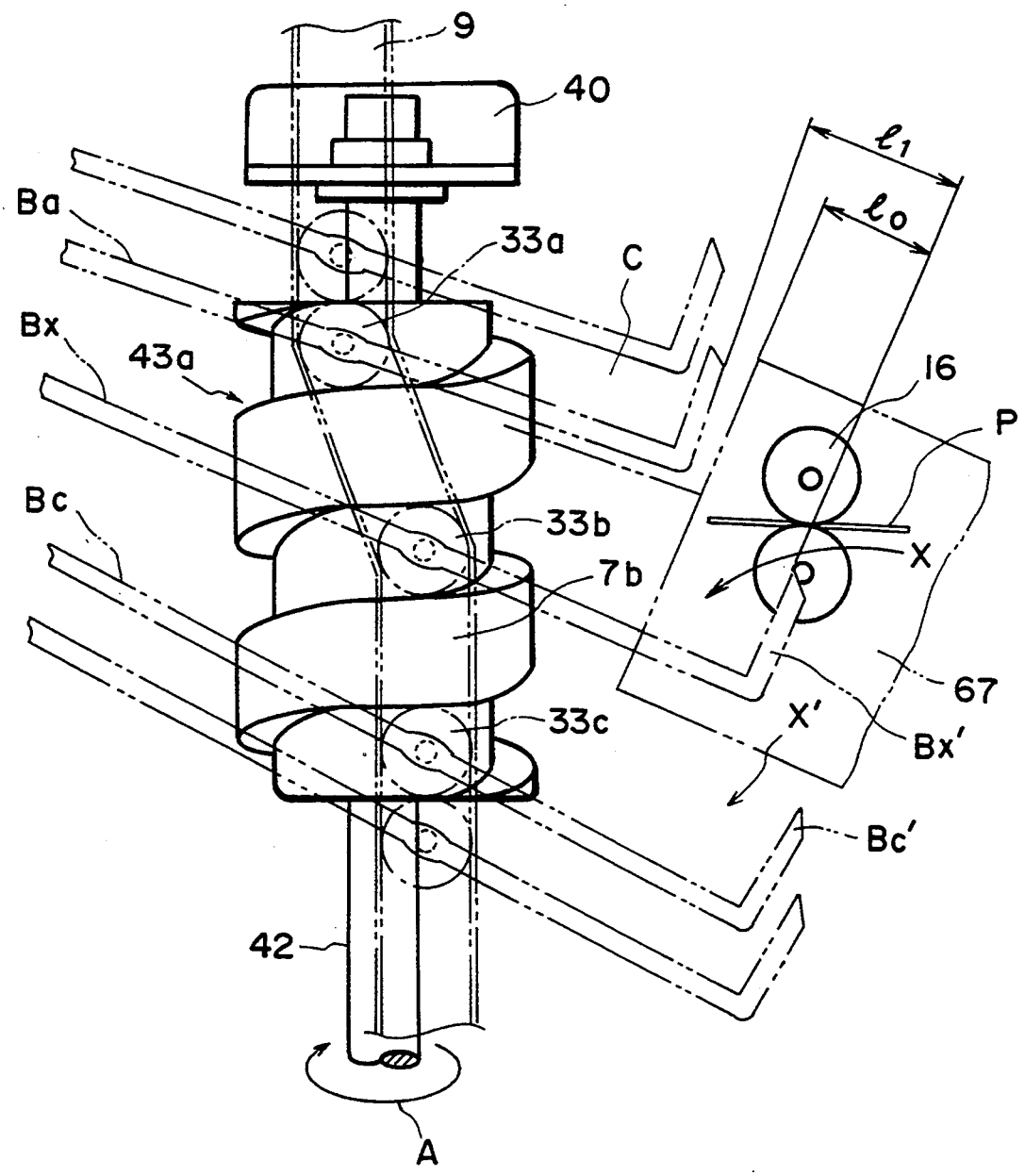
FIG. 11 is a side view showing in detail one of the helical cams.

As is shown in FIG. 11, the stapler advances the distance of $I_0$ within the distance of $I_1$ in the projection plan. Therefore, the height of the stapler can be taller than the bin interval.

Figure 17:
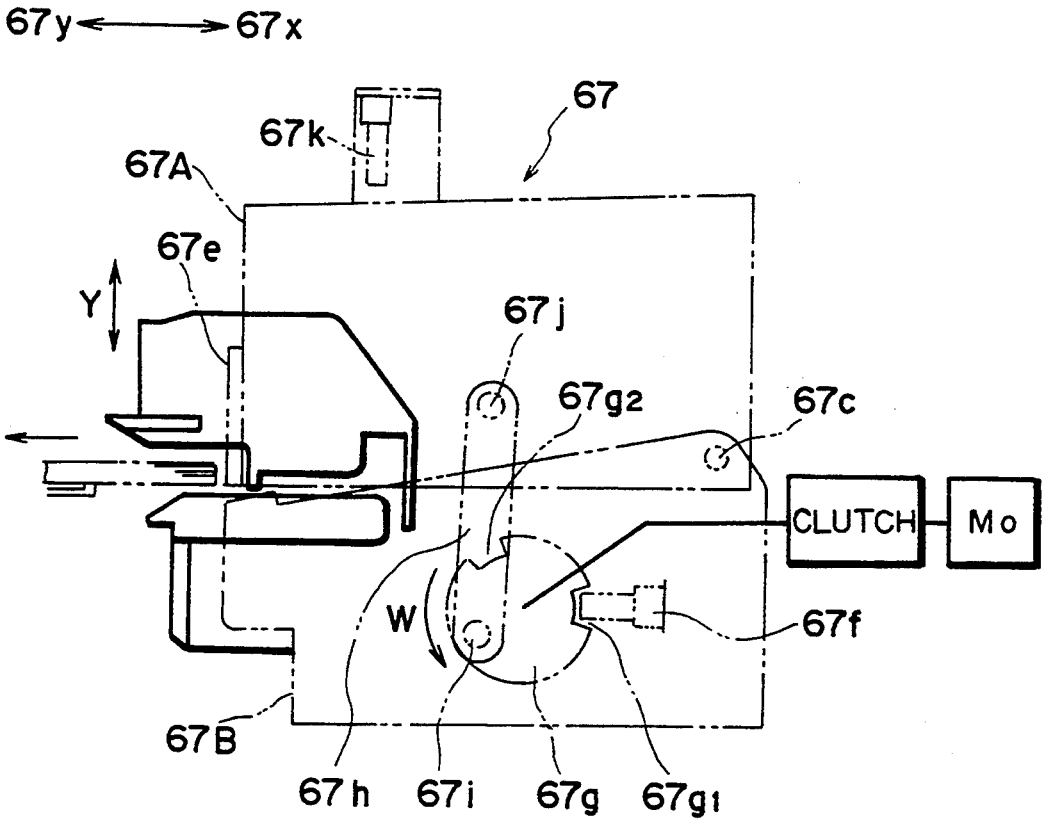
FIG. 17 is a plan view showing the driving system for the mechanism for opening or closing the stapler.

In FIG. 17, the schematic diagram of the mechanical configuration of a stapling unit 67 of the embodiment of the present invention is shown. Reference numeral 67 represents a sheet stapling apparatus (stapler), 67A the upper unit of the stapler, and 67B the lower unit of the stapler. Upper unit 67A swings about rotational center 67C in the Y direction to provide the stapling operation. As to the movement of upper unit 67A, as link disk 67*g* is swung in the W direction by stapler driving motor $M_0$, link arm 67*h* reciprocates. One end of the link arm is axially supported by upper unit 67A, and the other end by link disk $67_1$, which is supported axially by the lower unit. Therefore, as the link disk rotates once, upper unit 67A of the stapler 67 swings in the Y direction, thereby the hammer 67*b* advances to push the staple and retracts to complete a cycle of the stapling operation. Reference numeral 67*f* represents the link disk detection sensor, and 67*k* is the position sensor for detecting position of the upper unit (stapler home position sensor). When the fist recessed section $67g_2$ of link disk is detected by link disk detection sensor 67*f*, one end of upper section 67A of the stapler is detected by upper unit position sensor 67*k*, thereby it is confirmed that the stapler is at the home position.

When the second recessed section $67g_1$ of the link disk is detected by 67*f* (67*k* is off) (FIG. 17), stapler upper unit 67A and stapler lower unit 67A close their distance. At this time, the staple remains in the same state as it is when the stapling unit 67 is at the above mentioned home position since hammering plat (hammer 67*b*) in the stapling unit has not initiated its operation (sticking out further). In addition, 67*e* is a sheet nudging plate positioned at the tip of the upper unit and consists of a flat piece of plate (the adoption of a soft material for nudging the sheet helps prevent damage at the tip of the sheet).

Next, the post-processing operation of this embodiment after the completion of the delivery, sorting, and stacking operations of the sheets is explained.

Figure 6:
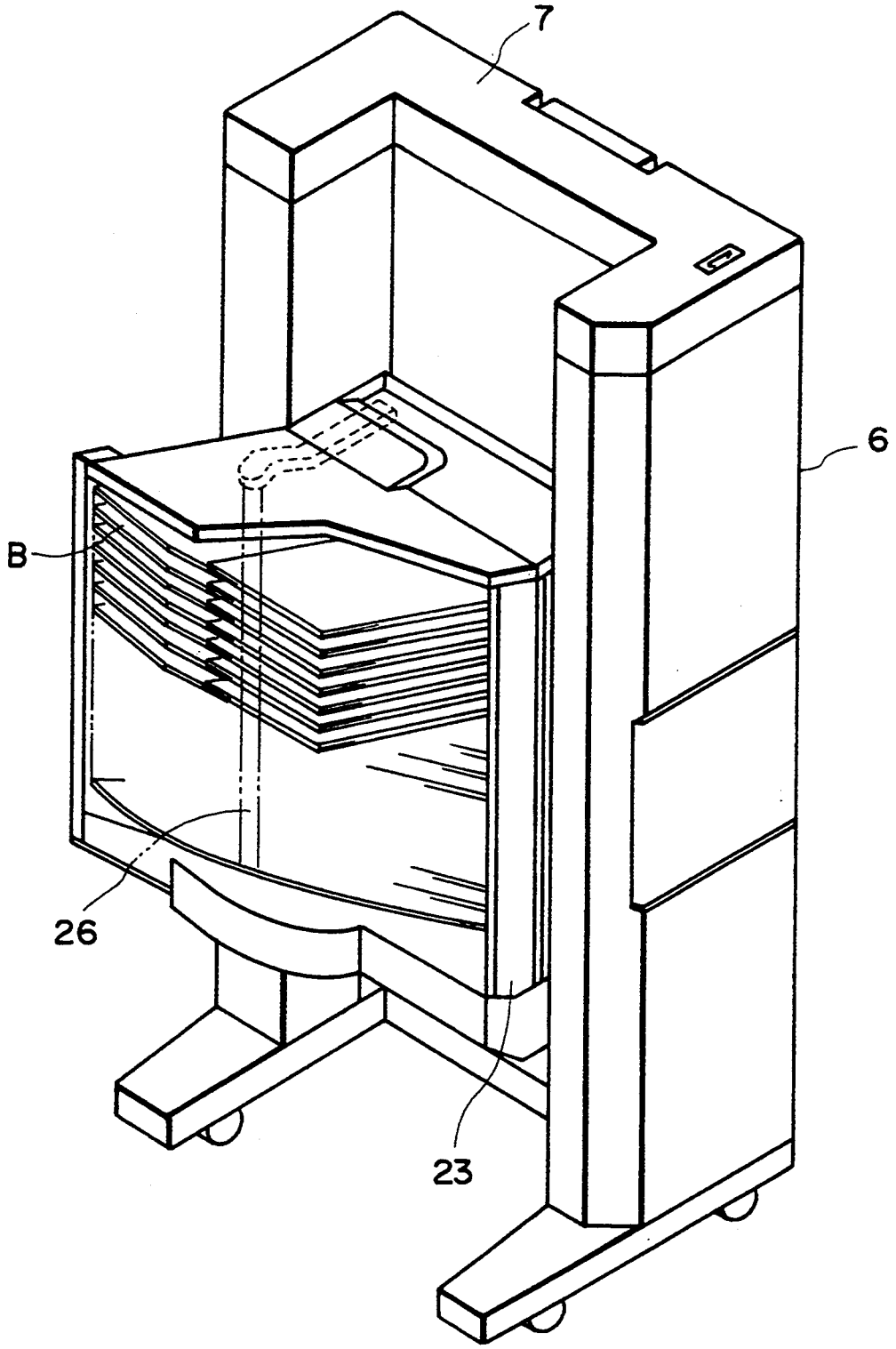
FIG. 6 is a perspective view showing the status of the same sheet post-processing apparatus after the completion of the sorting operation.
Figure 7:
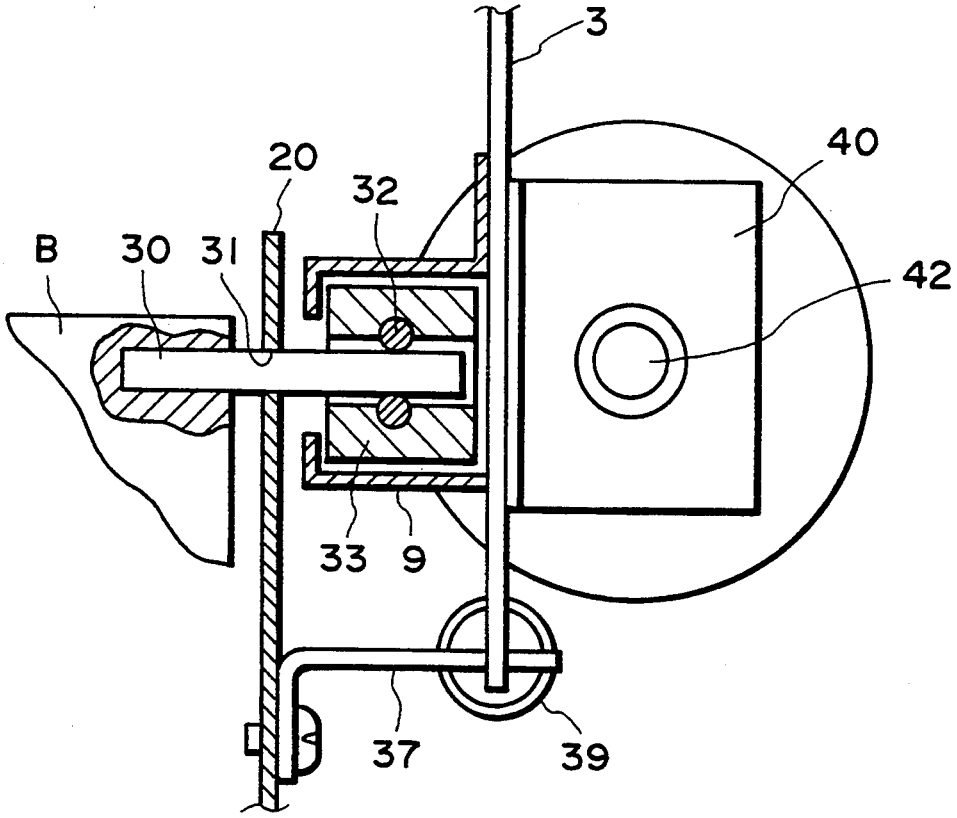
FIG. 7 is a plan view showing the cross section of the trunnion.

FIG. 6 is presented to show one example of how this embodiment looks after the completion of the sorting and stacking of the sheets. Then, the single bin skip offset operation of this embodiment after the completion of the above mentioned preceding operations is explained.

When the last sheet is discharged and stacked into the last bin Bx and the last sheet discharge signal is sent out from the sorter control circuit, motor $M_0$ of the stapler 67 in the stapling unit operates if the offset mode has been set by the bin shift control circuit and the staple unit driving control circuit. Then, upper unit of the stapler 67 descends, as is shown in FIG. 17, to narrow the space between sections 67*b* and 67*b'*, and sheet nudging plate 67*e* is positioned at the sheet nudging position. Next, the stapler is moved, while holding the same state, to stapling position 67Y from retracted position 67X in FIG. 2 by the stapler reciprocating mechanism shown in FIG. 16. Then, the sheet stack which has just undergone sorting, stacking, and aligning operations is nudged by sheet nudging plate 67*e* to be moved laterally from the first aligning position to the second aligning position. That is, because of the facts that the coefficient of friction between the bin and the sheet is as small as 0.3 and that the bin is tilted toward the sheet nudging means, causing the center of gravity to be displaced toward the sheet nudging means, whereby one of the sides of the sheet is gently pressed against sheet stopper section $B_1'$ (FIGS. 1 and 2), a gentle nudge on the end of the sheet in the reciprocating direction of the stapler is sufficient to offset laterally (S direction in FIG. 4) the stack of sheets while being guided by the sheet stopper section $B_1'$.

Figure 18:
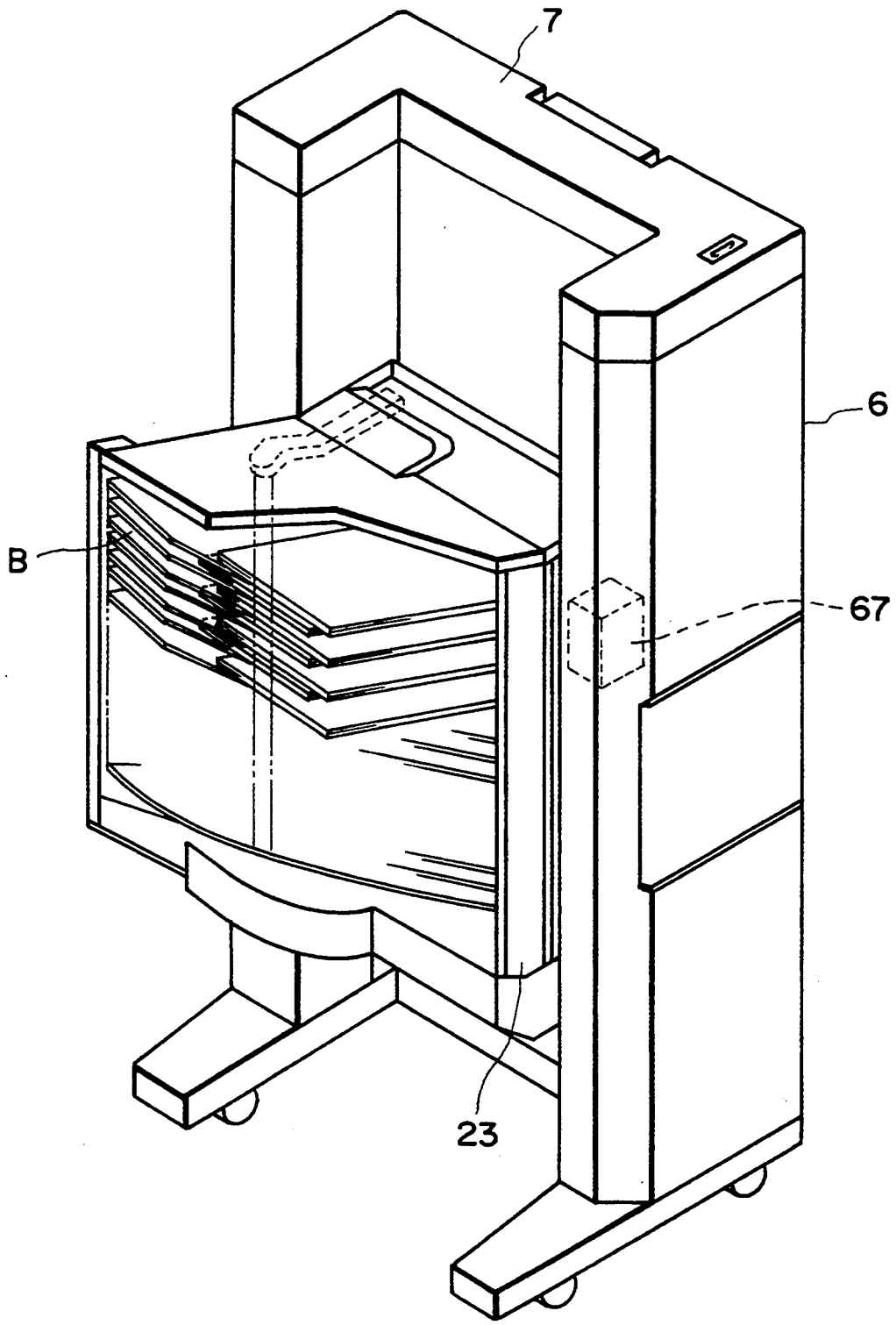
FIG. 18 is a perspective view showing the sheet stack arrangement after the completion of the offsetting operation.

When the stapler 67 is positioned at retracted position 67X after its completion of the reciprocating operation (67X–67Y–67X) while remaining in the above mentioned state, the bin shift operation begins. In the case of offset sorting, since the sheet stack in every other bins is to be offset from the first aligning position to the second aligning position, the bin shift operation is performed in the unit of two sequential bins and this operation is repeated in succession, eventually effecting the offset state wherein the sheet stacks in the adjacent bins are offset from each other, as is shown in FIG. 18. After the offset sorting ends, the stapler is rotated by motor $M_0$ in the opposite direction to W (FIG. 17) to be returned to the stapler home position.

Now then, let us discuss how a user should selectively use the sorting mode and the offset-sorting mode. If what the user needs results in sheet stacks consisting of a small number of sheets, the plain sorting mode is satisfactory since the breaks between the sheet stacks in the adjacent bins can be easily found. On the other hand, in the case of the sheet stacks consisting of a large number of sheets, it is preferable to use the offset-sorting mode for improved handling efficiency. Also, if it is found to be difficult to handle the sheet stacks after the completion of sorting and stacking operation, it is only necessary to press the manual offset button at this time, whereby the offset-sorting mode can be performed even after the completion of the initial selection of the plain sorting mode.

Next, the offset mode in combination with the stapling operation (staple-offset-sorting) is explained.

In the case of the offset-staple-sort mode of this embodiment, after the sheets are discharged into their respective bins, the stapling operation is initiated, by the sheet discharge signal of the last sheet, at the bin into which the last sheet is discharged, in the .same manner as in the case of the offset-sorting mode. In other words, the stapler advances from retracted position 67X to stapling position 67Y and the link disk in FIG. 17 rotates once, thereby causing the stapling operation. At this time, regarding the bin where the sheet stack is to be offset, as the stapler 67 at the home position completes one cycle of operation, the stapler unit moves from 67Y to 67X as was explained referring to FIGS. 15 and 16. During this transition, the stapler 67 again rotates in the W direction from the home position up to the point at which recess section $67g_1$ of the link disk is detected by 67*f* and the opening between the upper and lower units of the stapler is closed. While remaining in this state, the stapler is again displaced in the succession of 67X–6-7Y–67X without shifting the bin at which stapling has been just completed, thereby accomplishing stapling-offsetting.

When stapling-offsetting is completed for one of the bins as was described above and the stapler 67 is returned to retracted position 67X, the bins are shifted by one position to align the following bin. This time, the stapler 67 operates in the normal stapling mode (without offsetting), and then, the bins are shifted again by one position so that the stapler 67 again operates in the stapling-offsetting mode, and so on, alternating between the stapling-offsetting mode and the plain stapling mode, effecting the sheet stack arrangement as shown in FIG. 18 wherein the sheet stacks in all of the bins are stapled and offset.

Also in this case, even if the plain sorting mode is selected at first, the stapling-offsetting operation can be performed later just by pushing the manual staple button and the manual offset mode button, and furthermore, even if the staple-sorting mode is selected at first, the manual offset button can be pushed to perform the offsetting operation later.

In this embodiment, the so-called serial processing is performed, that is, the plain stapling operation and the stapling-offsetting operation are alternated for every other bin. However, it is possible to finish stapling the sheet stacks in all of the bins first, and then follow with the operation of offsetting the sheet stacks in every other bin.

Figure 19:
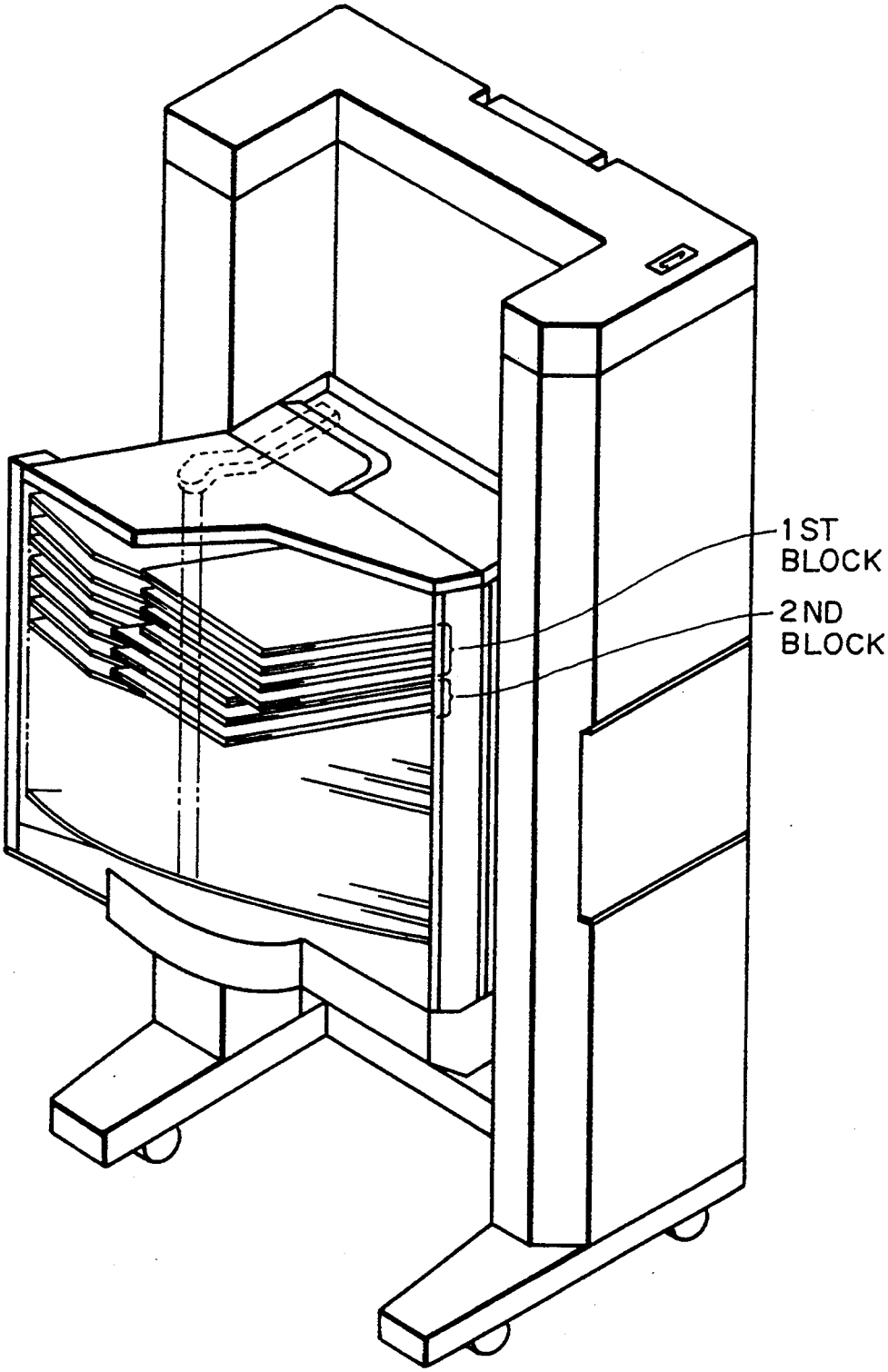
FIG. 19 is a perspective view showing the sheet stack arrangement after the completion of the grouping operation.

Also, as is shown in FIG. 19, this configuration may be used to group the sheet stacks into blocks. This grouping function can be useful to realize a simple automated system crated by connecting a copying machine having a reserve function to a sorter-aligner apparatus. In the past, one bin was reserved to separate the first block of bins from the ones in the second block. However, if this offset function is utilized to sort the first block in the normal mode and the second block in the full offsetting mode, the sheet stacks are arranged in the manner as shown in FIG. 19, allowing the use of an extra bin for sorting, since it is not necessary to reserve one bin between two blocks.

In this case, if the software is written to prevent the selection of the offset mode by the user of the second block when the first user selects the offset mode to sort the first block, it becomes possible to separate the first block of the sort group from the second block.

As was explained above, the offsetting operation can be set up not only for every other bin but also for any optional arrangement to be used for improving the operational efficiency as well as dividing the sort groups into blocks.

Figure 20:
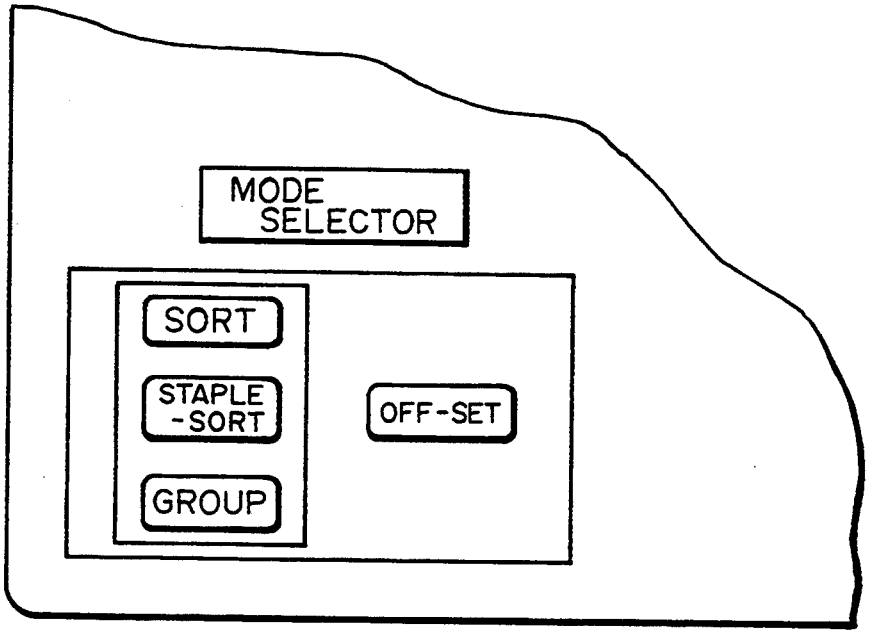
FIG. 20 is a plan view showing the control panel.
Figure 21:
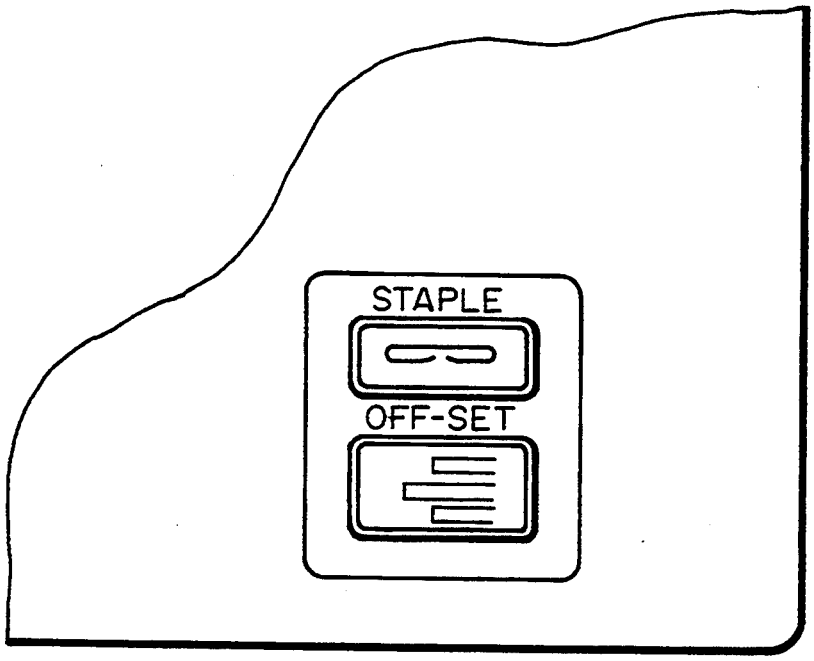
FIG. 21 is an enlarged partial plan view of the control panel.

FIG. 20 is a schematic diagram showing the mode selection buttons of the image forming apparatus assembly, and FIG. 21 is a schematic diagram showing the manual operation buttons of the post-processing apparatus.

Referring to FIG. 20, the mode buttons can be used to select the sort, staple-sort, or group modes, as well s the simultaneous selection of the offset mode, whereby a total of six combinations are available (sort, offset-sort, staple-sort, offset-staple, sort-group, offset-group).

FIG. 21 shows the manual operation panel of the post-processing apparatus. As was stapled before, these buttons one the panel are auxiliary buttons by which the necessary functions can be additionally performed in consideration of such a situation that a user just selects only the sort mode at first, for example, and starts a copying machine, and then, seeing the state of the copying machine wherein only the sorting operation has been finished, the user wants the offset arrangement for easy removal of the sheets, or that the user forgets to select the stapling mode and wants to staple the sheets afterward.

Figure 24:
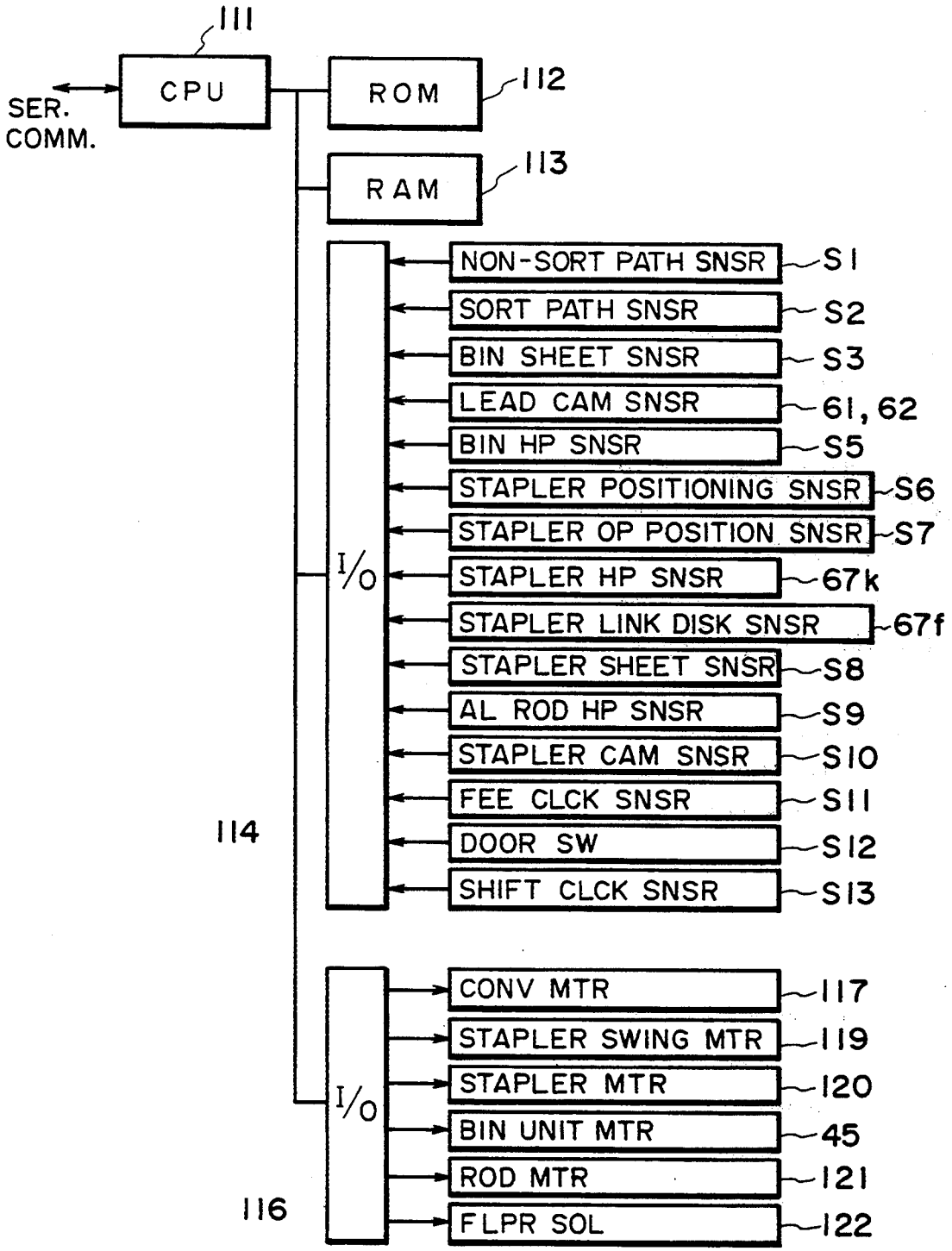
FIG. 24 is a schematic block diagram of the preferred embodiment in FIG. 1.
Figure 25:
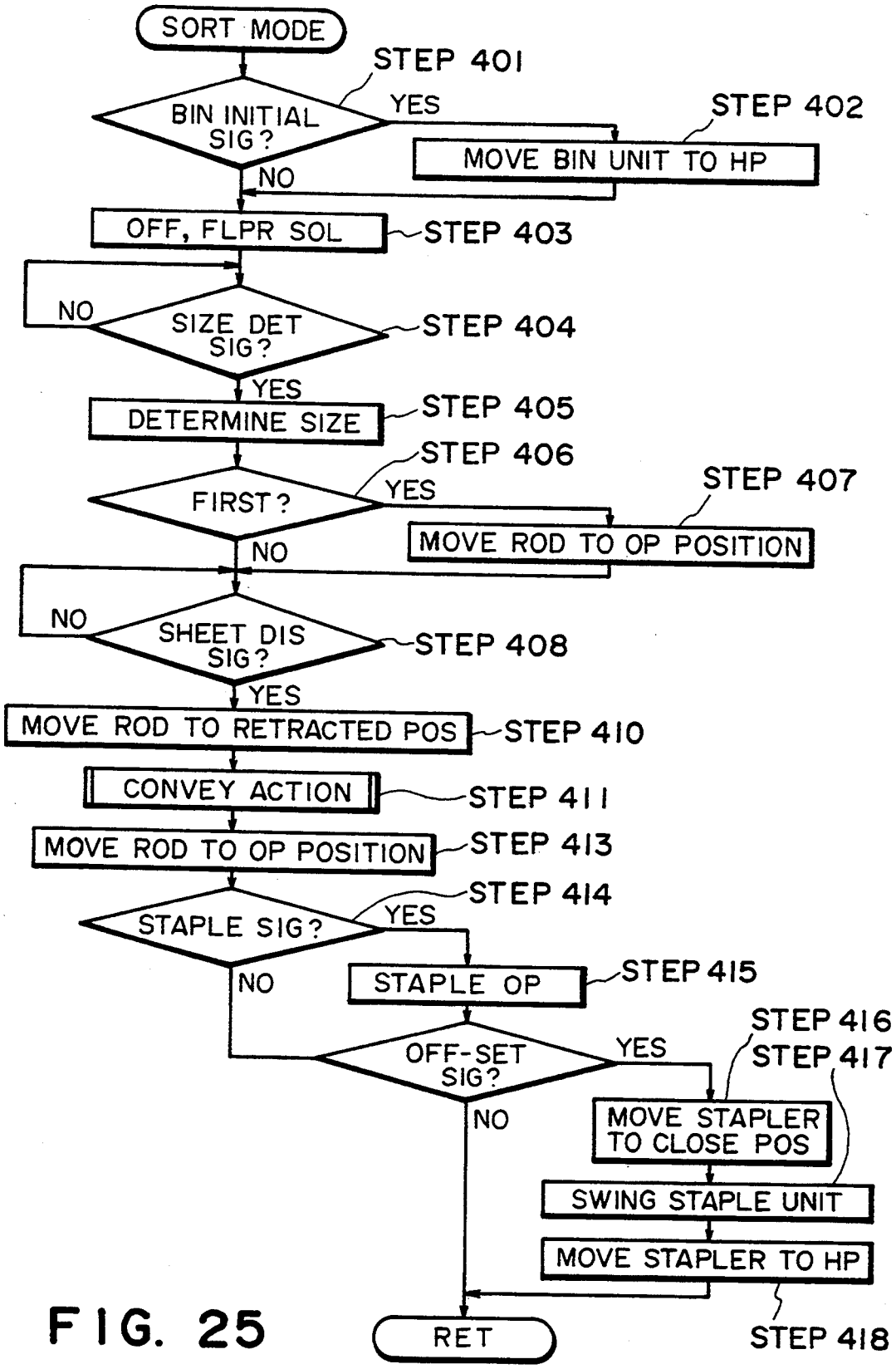
FIGS. 25–27 are flow charts of the sequential operations of the apparatus in accordance with the present invention.
Figure 26:
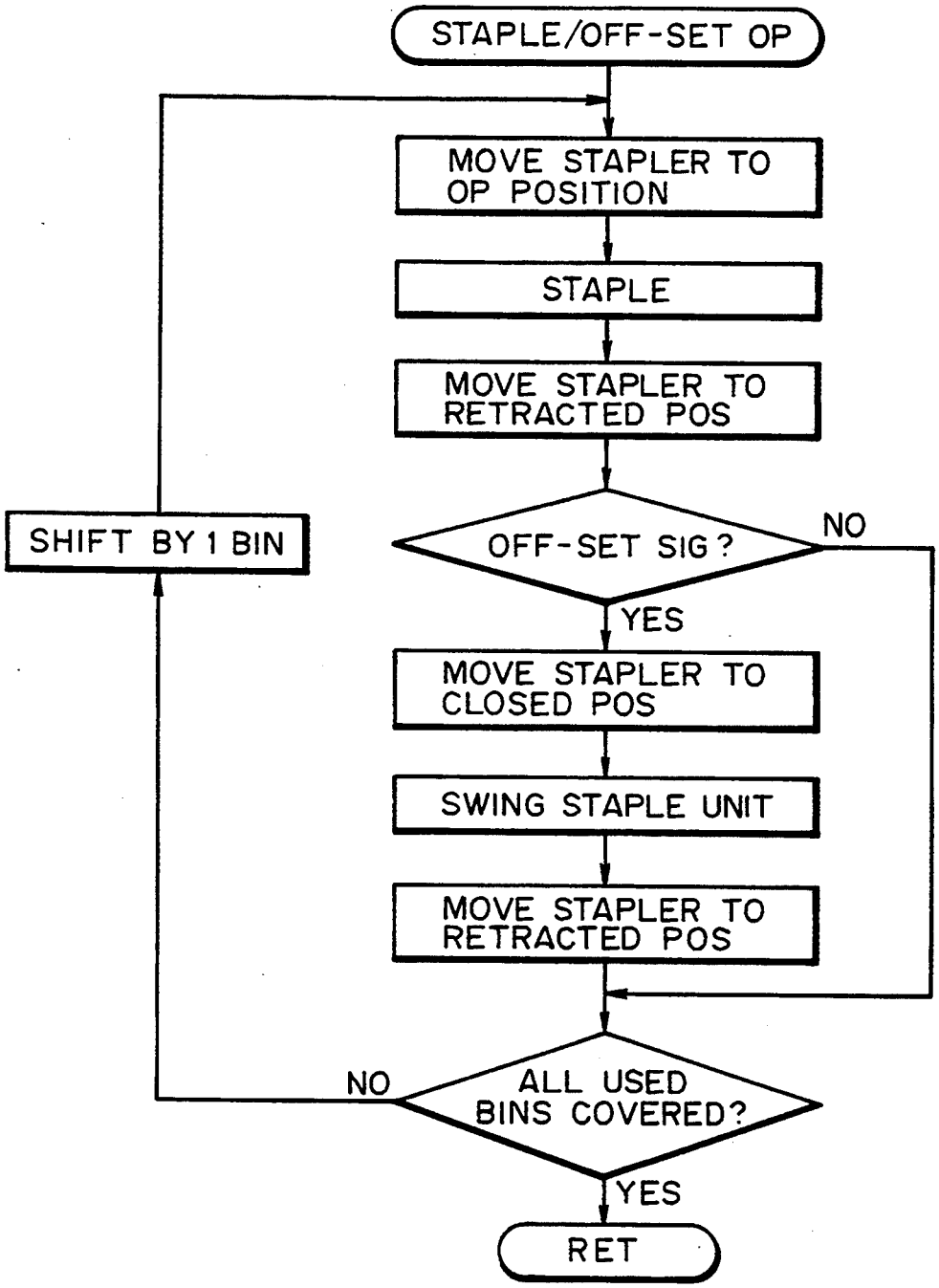
Figure 27:
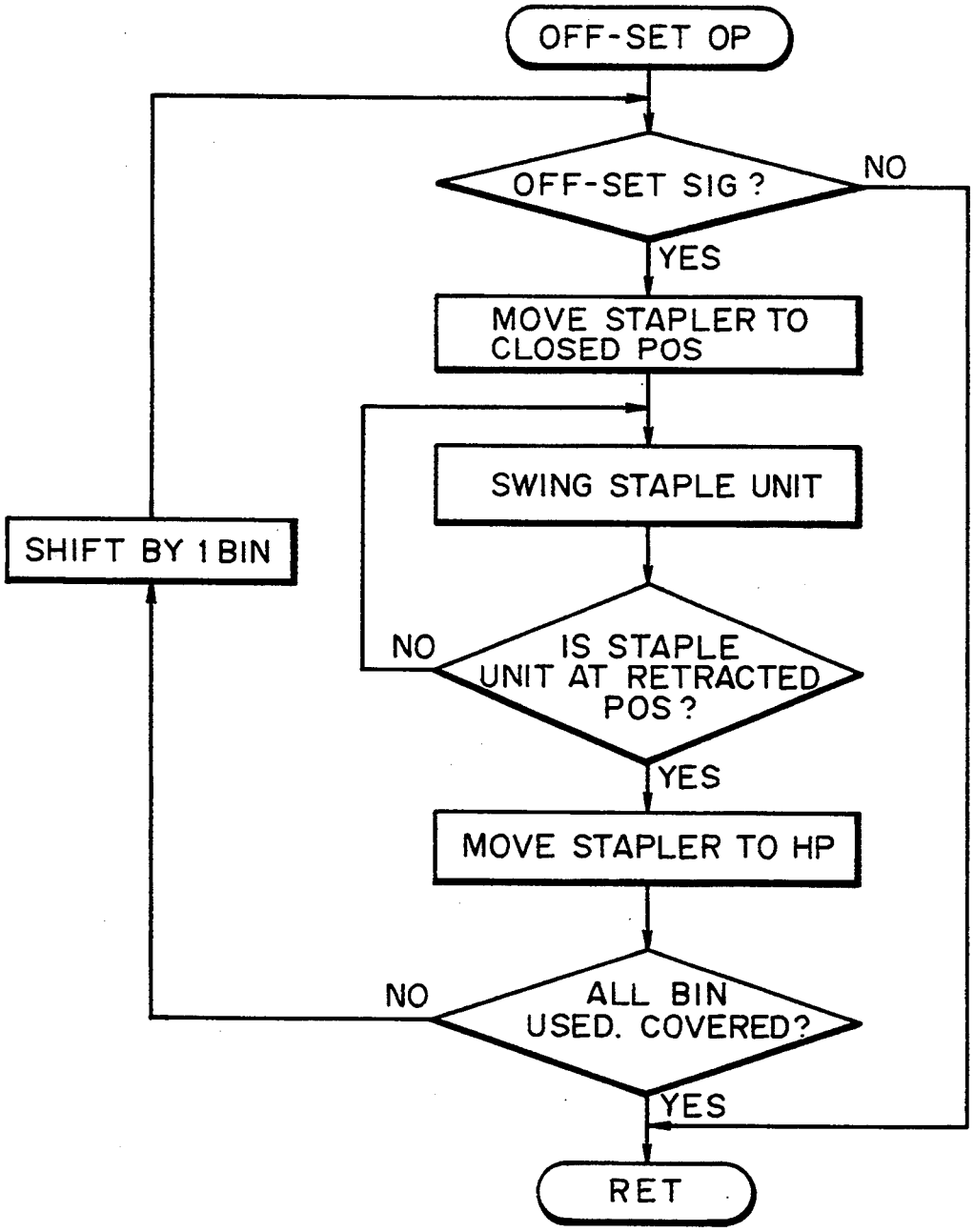

The block diagram is presented in FIG. 24, and the flow charts are presented in FIGS. 25, 26 and 27.

The stapler in the flow chart represents the sheet stapling means itself, and the staple unit represents the stapling assembly including the reciprocating table which swings the stapler between the retracted position and the stapling position. Therefore, the expression "stapler home position" implies the open state of the stapler 67 in FIG. 16 in which the stapling means is open, and the expression "closed stapler position" implies the closed state of the stapler 67 as shown in FIG. 17. In addition, "swing staple unit" means that the stapler unit moves in a manner of 67X–67Y–67X, and "stapler unit retracted position" means the state in which the stapler is at 67X (FIG. 2).

Next, the sort mode operation is explained referring to FIG. 25.

A decision is made as to whether or not there is the presence of the bin initial signal which is sent from the copying machine and is used to determine whether or not the bin unit 2 is to be moved to the home position (step 401), and only when there is, the bin unit 2 is moved to home position 2 (step 402). Next, in order to select sort discharge outlet 16, flapper solenoid 122 is deactuated (step 403), and then, the program proceeds to step 404. In step 404, the program waits for the size determination signal, and as it receives the size determination signal, it proceeds to step 405. The size is determined in step 405, and then, it is decided whether or not the sheet of the determined size is the first sheet in step 406. Only when it is the first sheet, the aligning rod 26 is moved to the lateral shifting position **26*a* in step 407, and the program proceeds to step 408. In step 408, the program waits for the sheet discharge signal from the copying machine main assembly, and as it receives the sheet discharge signal, the aligning rod 26 is moved to standby position 43*b* (step 410). Next, the sheet conveying operation is performed to deliver the sheet into the bin B (step 411). The aligning rod 26 is moved to lateral alignment position 26*a* (step 413), and the program proceeds to step 414. In step 414, it is decided whether or not a staple signal is present, and only when it is present, the stapling operation is performed (step 415). Then, it is determined whether or not the offset signal is present (step 416). If it is present, a cycle of the offset operation is performed (step 416–418**), and the program returns to the main routine.

Incidentally, FIG. 26 is a flow chart which represents the case in which the staple-offset button is pressed after the completion of the sorting operation, and FIG. 27 is a flow chart which represents the case in which the offset button is pressed after the completion of the sorting operation.

Next, various other configurations are briefly explained.

Figure 13:
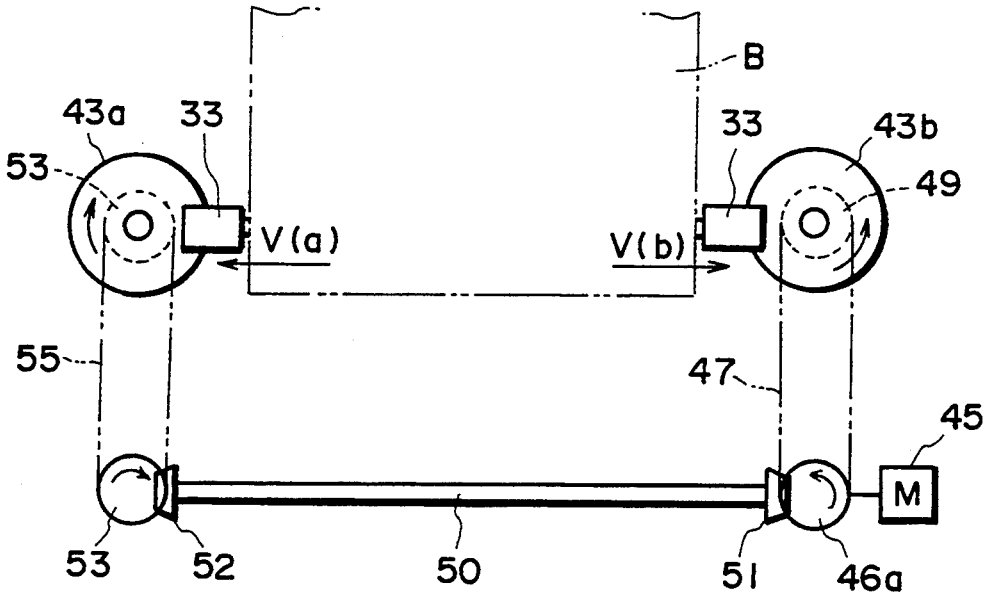
FIG. 13 is a plan view showing in detail the driving mechanism for the helical cams.

In FIGS. 8 and 13, reversible shift motor 45 is fixed to one of the side plates 3. To an output shaft **45*a* thereof, a bevel gear 46*b* integrated with a pulley 46*a* is fixedly attached, and the pulley 46*a* is coupled by a belt 47 with pulley a 49 fixed on a lead camshaft 42 of a lead cam 43*b*. The bevel gear 46*b* is meshed with a bevel gear 51 fixed to an end of the penetrating shaft 50, and a bevel gear 52 fixedly mounted to the other end of a penetrating shaft 50 is meshed with an unshown bevel gear integral with a pulley 53. As shown in FIG. 13, the pulley 53 is coupled by the belt 55 with the pulley 53 fixedly mounted on the lead camshaft 42 of the other the lead cam 43*a*. With the provision of the drive transmission system constructed in the manner described above, the lead cams 43***a* and 43*b* rotate in the direction indicated by an ,arrow in FIG. 13 or in the opposite direction, as the shift motor 45 rotates in the forward or backward direction.

To the other end (lower end in FIG. 8) of the output shaft 45*a* of the shift motor 45, clock disk 56 is fixedly mounted, and the number of rotations of the shift motor 45, that is, the number of rotations of lead cams 43*a* and 43*b*, can be detected by an interrupter 59 supported by sensor holder 57 mounted on one of the side plates 3, whereby the number of rotations of lead cams 43*a* and 43*b* can be controlled with the aid of a lead cam control circuit in the microcomputer of sorter 1.

Figure 9:
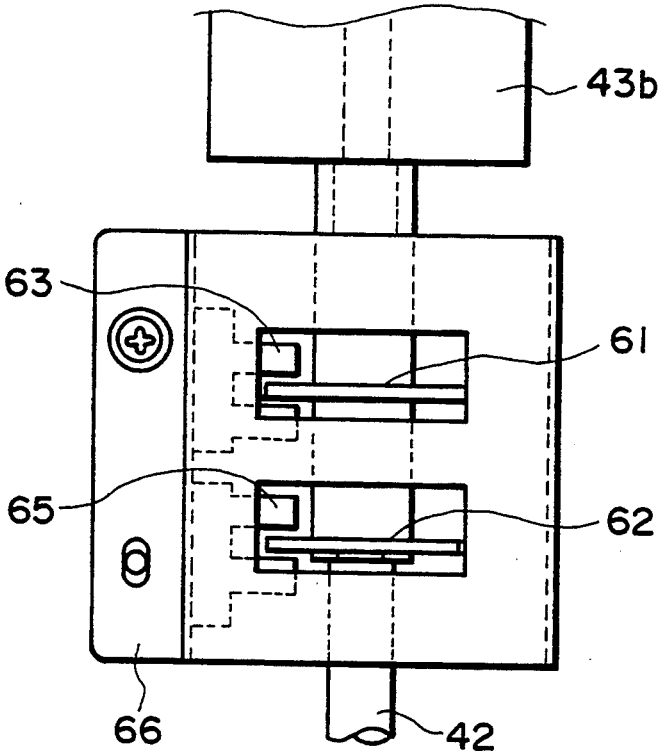
FIG. 9 is a side view showing the sensors.
Figure 10:
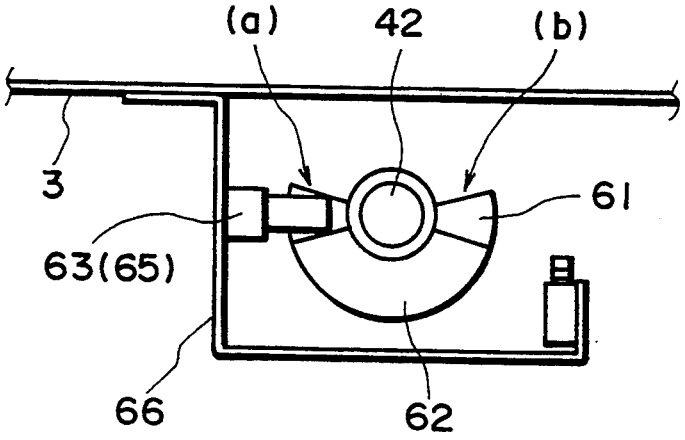
FIG. 10 is a top plan view showing the same.

A pair of flags 61 and 62 are mounted on lead cam shaft 42 at the point below the lead cam 43*b* shown in FIG. 3 to detect the position of lead cams 43*a* and 43*b*. FIGS. 9 and 10 are enlarged views thereof. In FIGS. 9 and 10, interrupters 63 and 65 are supported by a holder 66 fixed on side plate 3 to read flags 61 and 62.

Interrupters 63 and 65 have identical flag angles, but their phases are different by a predetermined amount. Interrupters 63 and 65 deliver on and off signals corresponding to this phase difference, whereby it is detected, in a manner which will be described hereinafter, whether the bin B is at the upward home position or the downward home position.

Lead cams 43*a* and 43*b* have parallel portions (approximately 180 degrees) as will be described later. The phase difference between flags 61 and 62 is determined corresponding to the parallel portion. In this example, the phase difference between flags 61 and 62 is a predetermined angle (approximately 30 degrees), and on the basis of the on and off states of interrupters 63 and 65 due to the angle deviation between flags 61 and 62, the positions of lead cams 43*a* and 43*b* are decided.

Next, the movement of the bin B determined by the configurations of lead cams 43*a* and 43*b*, and the trunnions (bin rollers) 33 engaged therewith is explained.

Figure 12A:
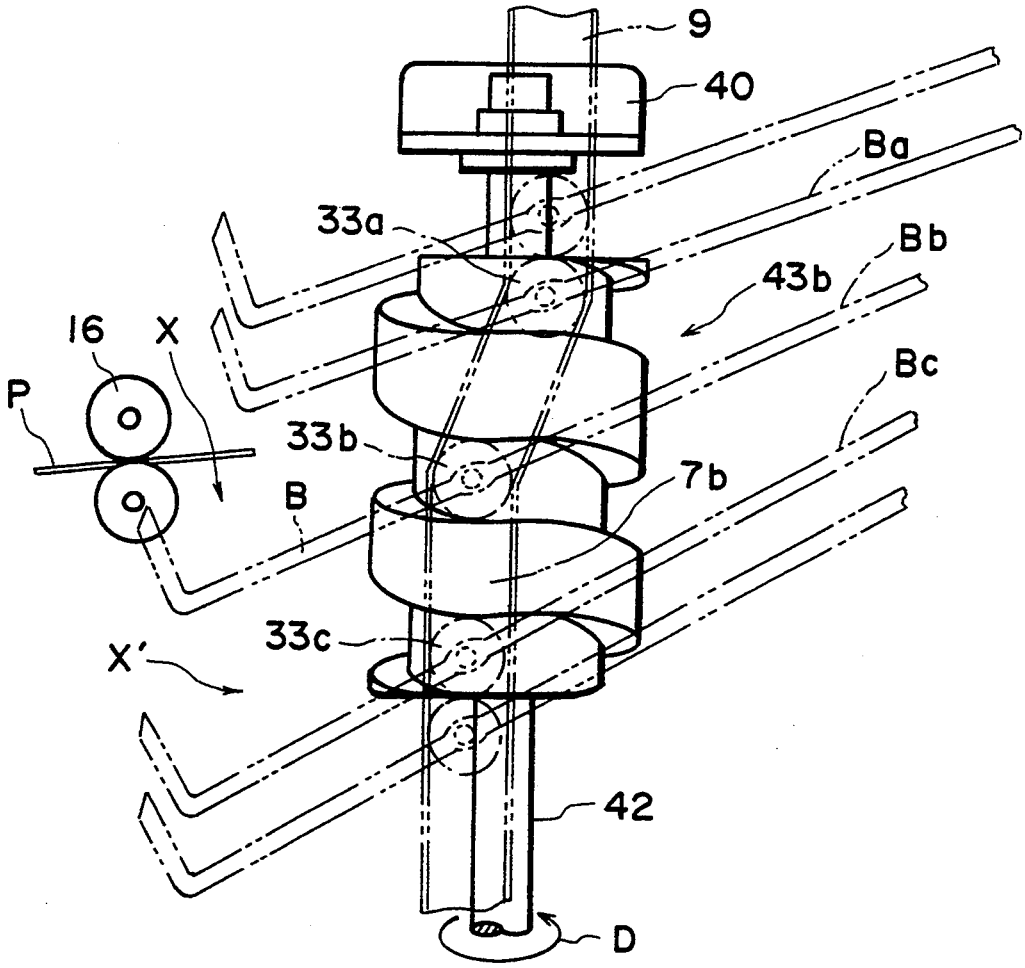
FIGS. 12A, 12B are side views showing in detail the other helical cam.
Figure 12B:
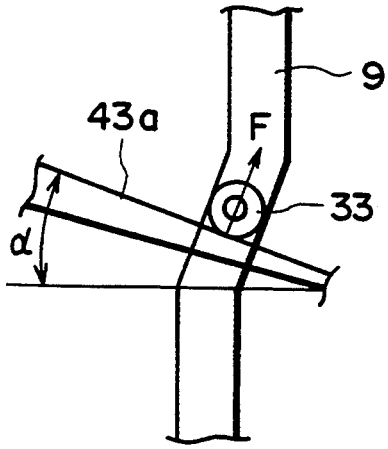

FIG. 11 shows the relationships among left lead cam 43*a*, the trunnion 33, and the bin B, and FIG. 12 shows the relationship between right lead cam 43*b* and the trunnion 33. FIG. 13 is a plan view of the drive transmission system for lead cams 43*a* and 43*b*.

As shown respectively in FIGS. 11 and 12, the helical gear profiles of lead cams 43*a* and 43*b* in this embodiment are formed to have opposite directions so as to provide counter rotational directions, that is, both are mirror-symmetric. In addition, in this embodiment, the lead cams are provided with two full turns of threads in order to expand bin intervals at two expanded intervals X and X', the latter of which is required for sheet stapling mechanism 67 which can advance into and retract from the bin B, and if sorting is the only function desired, expanded interval X through which the sheet P is delivered is sufficient as the above mentioned expanded interval.

As lead cams 43*a* and 43*b* are driven by the shift motor 45 to rotate in the counter rotational directions shown by arrows, respectively, the trunnions 33 are urged into the grooves of lead cams 43*a* nd 43*b* and are guided along the guide rail 9 to move up and down. Incidentally, a part of the guide rail 9 shown in FIG. 11 is slightly bent because the sorter 1 in this embodiment is provided with the sheet stapling mechanism 67, requiring the bin B to be displaced in the forward or backward direction (advancing direction of the sheets). This structure is not limiting in the present invention.

Figure 14A:
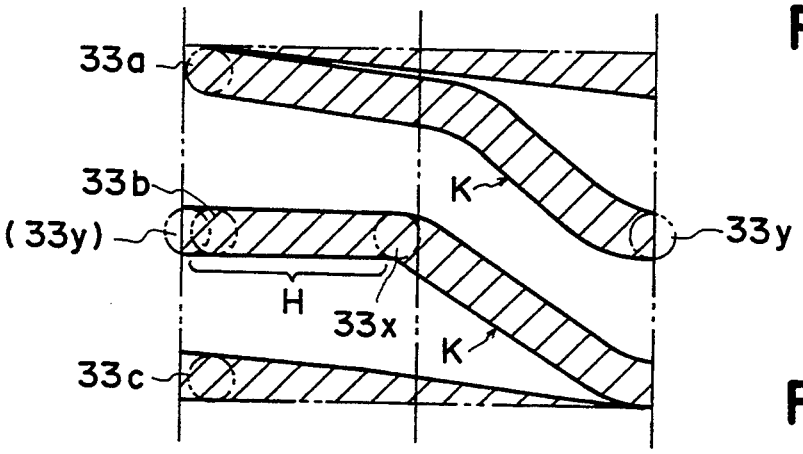
FIGS. 14A, 14B are schematic diagrams showing the helical cam profile.
Figure 14B:
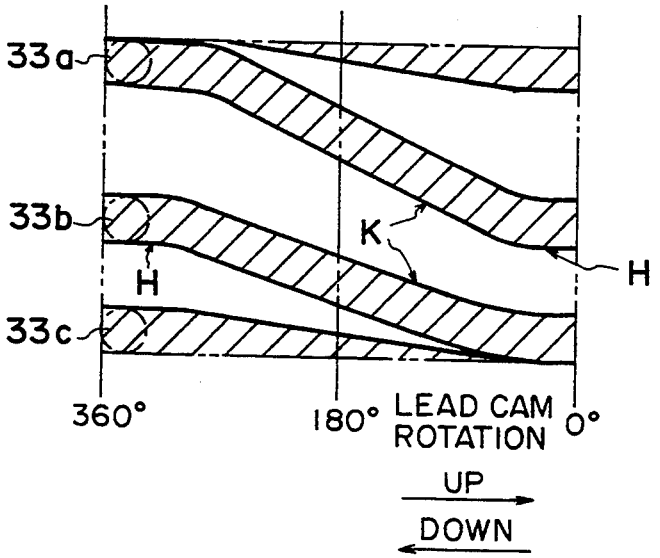

FIG. 14(*a*) shows a cam profile diagram of the lead cam 43*a* of this embodiment, and FIG. 14(*b*) shows an example of different cam profile diagram, respectively. Incidentally, the hatched sections in the figures shows the cam grooves of the lead cam 43*a*. Both cam profile diagrams in FIG. 14(*a*) and FIG. 14(*b*) are for the left side cams (with respect to the advancing direction of the sheet P). The cam profile diagrams for lead cams 43*b* on the opposite side are mirror-symmetric to these diagrams. The above mentioned cam profile diagrams cover the range of 0–360 degrees, and since both of them are for this embodiment, they are cam profile diagrams representing two full turns of threads.

The positions of the trunnion 33 in the groove of the lead cam 43*a* are indicated by reference numerals 33*a*, 33*b* and 33*c*. The position indicated by reference numeral H in FIG. 14 corresponds to the parallel portions of the lead cam 43*a*, which extend approximately 180 degrees in this embodiment. In the above mentioned cam profile diagram, when the lead cam 43*a* moves to the right, that is, when the lead cam 43*a* rotates in the direction of the arrow in FIG. 12 (relatively, the trunnion 33 moves to the left), the bin B is lifted. When the lead cam 43*a* moves to the left (relatively, the trunnion 33 moves to the right), the bin B is lowered. Parallel portion H shows the sheet discharge position of the lead cam 43*a* and inclined portion K shows the shifting position.

The rotation of the lead cam 43*a* is timed so as for parallel portion H to correspond to the timing when the sheet P is discharged by lower discharge rollers 16 in FIG. 1. Therefore, the home position when the trunnion 33 is raised is position 33X, and the home position when the trunnion 33 is lowered is position 33Y. The phase difference between home position 33X and home position 33Y is 180 degrees in this embodiment, as shown in FIG. 14(*a*). Positions 33X and 33Y of the lead cam 43*a* correspond to flag regions (a) and (b) in FIG. 10.

(Alternative Embodiment)

In the embodiment explained above, as a means for nudging sheet stacks out, the closed head position (closed position) is provided on the stapler, which is different from the home position or the stapling position, whereby the movement of the stapler unit between its retracted and advanced positions (stapling position) can be used to offset the sheet stacks, but the following alternative methods may be adopted.

Figure 22:
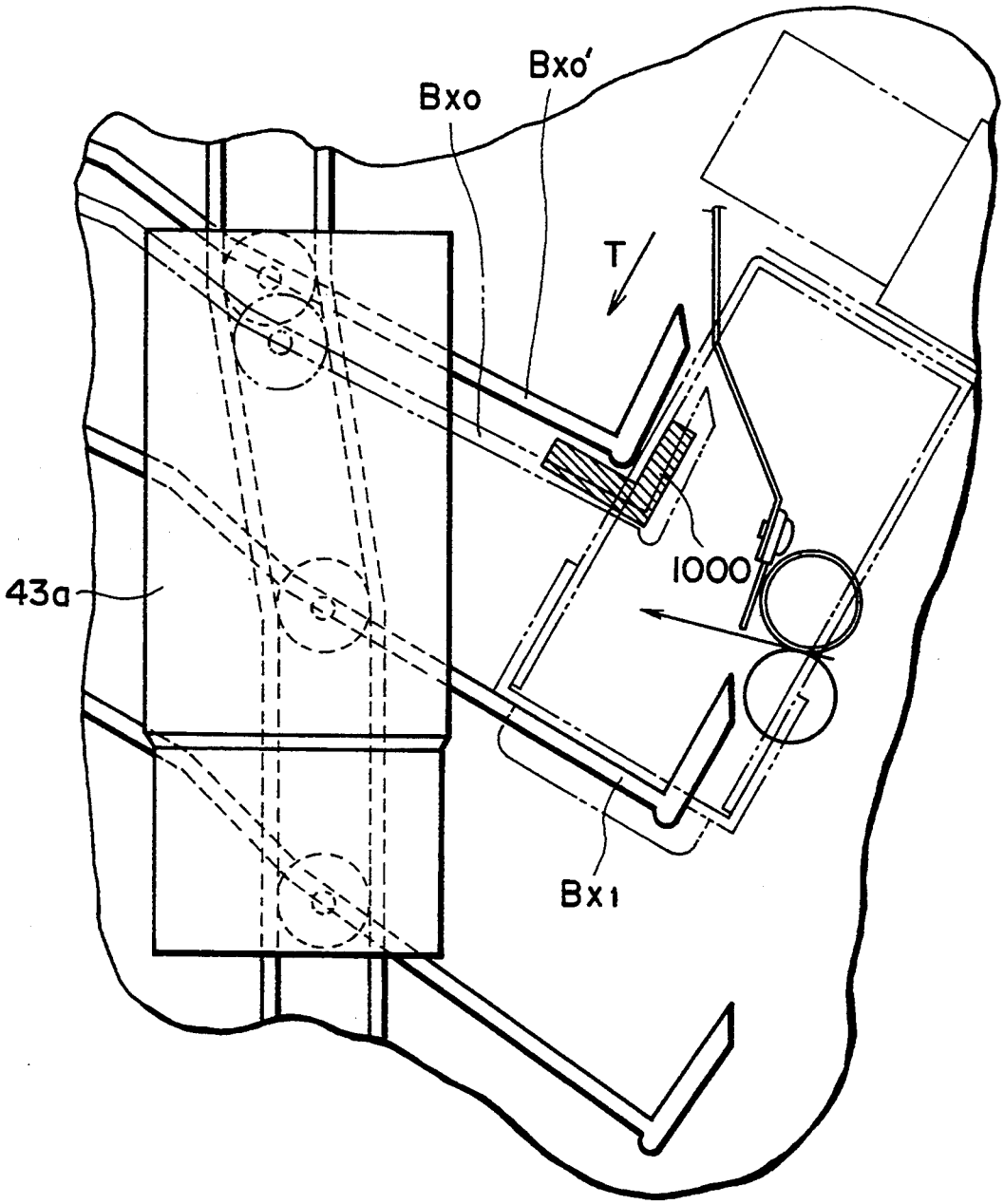
FIG. 22 is a plan view showing the essential section of an alternative embodiment of the present invention.
Figure 23:
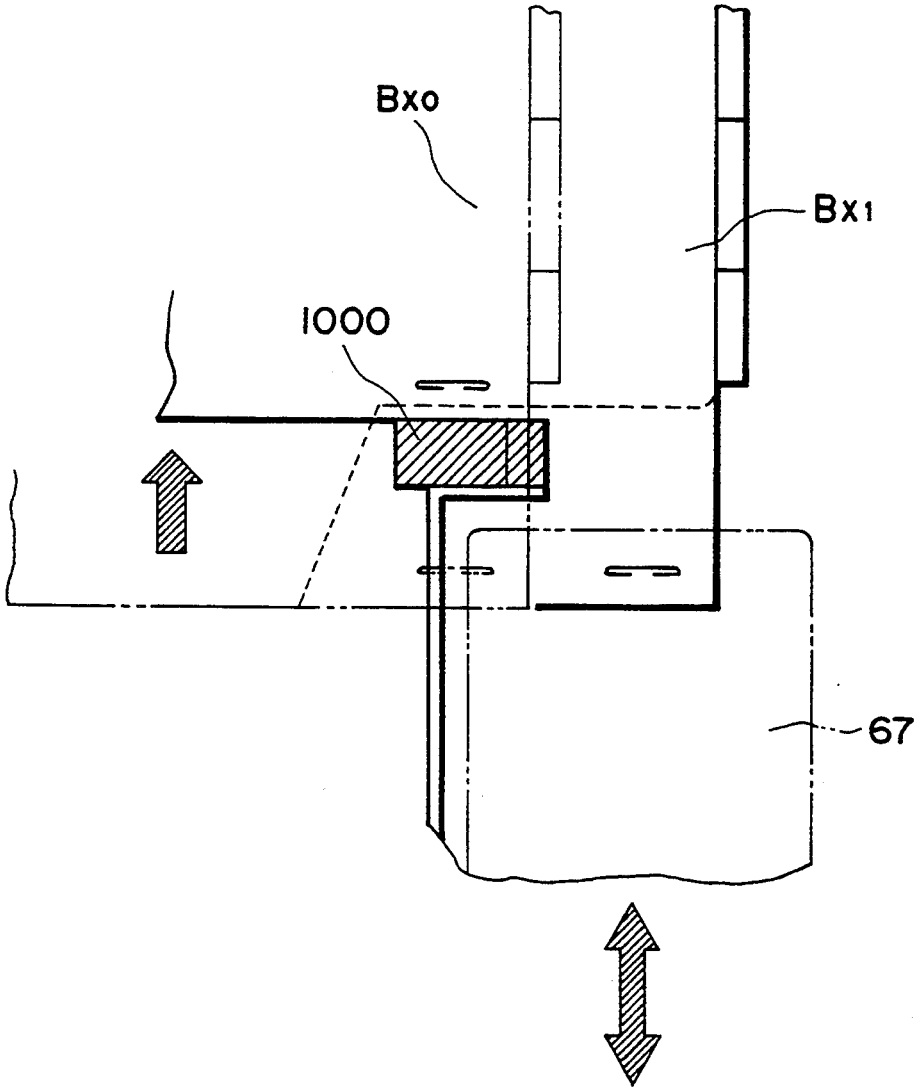
FIG. 23 is a plan view showing the stapling process of the same.

(1) If the normal sort home position and the reverse sort home position during the bin shift are differently (bin position is varied) configured (rotational angle of helical cam 43*a* is changed), as shown in FIGS. 22 and 23, so that the nudging member 1000 provided on staple unit comes in contact with the sheet stack in the preceding bin $B_{x0}$ during the normal sort home position, the sheet stack in the upper bin can be offset by the swing operation of the stapler toward the sheet stack in the lower bin in the same manner as in the case of the embodiment explained above. Incidentally, the bin $B_{x0}'$ shows the home position of the bin $B_{x0}$ during reverse sorting. Regardless of the home position during normal or reverse sorting (as long as the change in the rotational angle of helical cam 43*a* remains slight), the position of stapling bin $B_{x1}$ does not change, since it corresponds to the parallel portion of the lead cams.

FIG. 23 shows a plan view from the T direction in FIG. 22. In the event this configuration is adopted, the offsetting operation can be performed for the upper bin at the same time the stapling operation is performed in the normal offset-staple sorting mode, reducing the time (during the offset-staple sorting mode) even though just for the normal sorting mode.

As the characteristics of this configuration, it is possible to put the sheet stack in the bin B in or out of contact with nudging member 1000 by means of changing the bin position relative to the stapler unit, and therefore, it is unnecessary to prepare two positions such as the home position or the closed position for the stapler itself. That is, in the case of the offsetting operation, whether or not the sheet stacks are going to be offset is determined by whether the staple unit is swung (67X–67Y–67X) while the bin is at the normal sort home position, or at the reverse soft home position. Therefore, the steps for opening or closing the staple can be eliminated.

(2) In the first embodiment of the present embodiment, the swinging movement of the staple unit is used to offset the sheet stack, but a sheet nudging swing arm (not illustrated), which is different from the staple unit, may be used to perform the offsetting operation.

(3) Also, in the first embodiment of the present invention, the shifting bin type sorting operation is explained, but the same type of sorting operation is also possible in a fixed bin type sorter if the staple unit which moves lap and down is provided with a means for coming in contact with the sheet stack in the bin while the stapler unit is moving back and forth between the retracted position and the stapling position.

(4) Further, in the first embodiment of the present invention, the stapler in the closed state is used to nudge the sheet stack, but if a swing plate is driven to advance or retract in front of stapler head opening **67*b***, by means of a solenoid, motor, or the like, in order to close its opening, the same effect as the closed position and the open position of the stapler can be obtained.

As was described above, according to the embodiment of the present invention, with the addition of the function for offsetting the sheet stack in every other bin.

(1) It becomes easier to remove the sheets (operational efficiency is improved).

(2) The breaks between the sheet stacks can be clearly seen even when stapling is done at the sheet end (in particular when a large number of sheets are stacked up), whereby it becomes easier to separate each sheet stack from the whole stack even if they are removed all at once from the sorter, since they are offset in every other bin.

(3) In case two groups (two persons) of copy sheet stacks are sorted by a single sorter, one group can be easily separated from the other by the offsetting operation on the sorting basis of the first block and the second block. Since the swing operation of the staple unit can be used to embody the present invention, such effects as described above can be brought about by an inexpensive and simple configuration.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus comprising:

plural bins positioned at predetermined intervals for accommodating discharge sheets;

sheet discharge means for discharging the sheets into said bins;

aligning means for aligning the sheets discharged by said sheet discharge means in each said plural bins to a first aligning position;

offset means for offsetting, by shifting the sheets relative to the bin having the sheets, the sheets in one of said bins to a second aligning position which is different from said first aligning position; and control means for selectively operating said offset means to offset the sheets in one bin relative to the sheets in the other of said plural bins.

2. A sheet post-processing apparatus in accordance with claim 1, further comprising:

retractable sheet binding means, wherein said offset means is provided on said binding means.

3. A sheet post-processing apparatus in accordance with claim 1, further comprising:

retractable sheet binding unit which is provided with a sheet binding means for binding the sheets in said bins, wherein said offset means is provided on said sheet binding unit.

4. A sheet post-processing apparatus in accordance with claim 1 or 2, wherein said offset means is equipped with a sheet pushing member movable between a contact position where it is in contact with the sheet stack in the bin and a non-contact position where it is not, and wherein the sheet stack is offset if the offset means advances into the bin when said sheet pushing member is at the contact position.

5. An image forming apparatus, comprising:

an image forming means for forming images on the sheets; and sheet post-processing means having plural bins positioned with predetermined intervals for accommodating discharged sheets, sheet discharging means for discharging the sheets into said bins, aligning means for aligning the sheets discharged by said sheet discharge means in said plural bins to a first aligning position, offset means for offsetting, by shifting the sheets relative to the bin having the sheets, the sheets in one of said bins to a second aligning position which is different from said first aligning position, and control means for selectively operating said offset means to offset the sheets in one bin relative to the sheets in the other of said plural bins.

6. An apparatus according to claim 1, wherein said aligning means operates each time a sheet is discharged to align the sheet to the first aligning position, and wherein said offset means operates for a selected bin to offset the sheets in the selected bin to the second aligning position.

7. A sheet post-processing apparatus, comprising:

plural bins positioned at predetermined intervals for accommodating discharge sheets;

sheet discharge means for discharging the sheets into said bins;

offset means for offsetting, by shifting the sheets relative to the bin having the sheets, the sheets in one of said bins; and control means for selectively operating said offset means to offset the sheets in at least one of said plural bins relative to the sheets in the other of said plural bins.

8. An apparatus according to claim 7, wherein said at least one of said bins includes every other one of said plural bins.

9. An apparatus according to claim 7, wherein said at least one of said bins includes a selected number of said bins, each of said selected bins being separated from an adjacent selected bin by a predetermined number of non-selected bins.

10. An apparatus according to claim 7, wherein at least one of said bins includes a block of continuous bins, and does not include a plurality of bins in the other of the block of continuous bins.

11. A sheet post-processing apparatus, comprising:

plural bins positioned at predetermined intervals for accommodating discharge sheets;

sheet discharge means for discharging the sheets into said bins;

offset means for offsetting the sheets by shifting the sheets relative to the bin having the sheets; and control means for operating said offset means to offset the sheets in at least one of said plural bins relative to the sheets in the other of said plural bins.

12. An apparatus according to claim 11, wherein said at least one of said bins includes every other one of said plural bins.

13. An apparatus according to claim 11, wherein said at least one of said bins includes a selected number of said bins, each of said selected bins being separated from an adjacent selected bin by a predetermined number of non-selected bins.

14. An apparatus according to claim 11, wherein said at least one of said bins includes a block of continuous bins, and does not include a plurality of bins in the other of the block of continuous bins.

15. An image forming apparatus, comprising:

an image forming means for forming images on the sheets; and sheet post-processing means having plural bins positioned with predetermined intervals for accommodating discharged sheets, sheet discharging means for discharging the sheet into said bins, offset means for offsetting the sheets by shifting the sheets relative to the bin having the sheets, and control means for operating said offset means to offset the sheets in at least one of said plural bins relative to the sheets in the other of said plural bins so as to permit the sheets to be accommodated in the bins in an offset state.

16. A sheet post-processing apparatus, comprising:

plural bins positioned at predetermined intervals for accommodating discharge sheets;

sheet discharge means for discharging the sheets into said bins;

offset means for offsetting the sheets by shifting the sheets relative to the bin having the sheets; and control means for operating said offset means to offset the sheets in at least one or more of said plural bins relative to the sheets in the other of said plural bins to provide differentiation between groups of sheets so as to permit the sheets to be accommodated in the bin in an offset state.

17. An apparatus according to claim 16, wherein said at least one of said bins includes a selected number of said bins, each of said selected bins being separated from an adjacent selected bin by a predetermined number of non-selected bins.

18. An apparatus according to claim 16, wherein at least one of said bins includes a block of continuous bins, and does not include a plurality of bins in the other of the continuous block of the bins.

19. An image forming apparatus, comprising:

an image forming means for forming images on the sheets; and sheet post-processing means having plural bins positioned with predetermined intervals for accommodating discharge sheets, sheet discharging means for discharging the sheets into said bins, offset means for offsetting the sheets, and control means for operating said offset means to offset the sheets in at least one of said plural bins relative to the sheets in the other of said plural bins to provide differentiation between groups of sheets so as to permit the sheets to be accommodated in the bin in an offset state.

20. An image forming apparatus, comprising:

an image forming means for forming images on the sheets; and sheet post-processing means having plural bins positioned with predetermined intervals for accommodating discharge sheets, sheet discharging means for discharging the sheet into said bins, offset means for offsetting, by shifting the sheets relative to the bin having the sheets, the sheets in one of said bins and control means for selectively operating said offset means to offset the sheets in one of said plural bins relative to the sheets in the other of said plural bins so as to permit the sheets to be accommodated in the bin in an offset state.

21. A sheet post-processing apparatus comprising:

plural bins positioned at predetermined intervals for accommodating discharge sheets;

sheet discharge means for discharging the sheets into said bins;

offset means for offsetting, by shifting the sheets relative to the bin having, the sheets discharged by said sheet discharge means into a selected bin so as to permit the sheets to be accommodated in the bin in an offset state.

22. An apparatus according to claim 21, wherein said offsetting means includes a member for pushing the sheets on said selected bin.

23. An apparatus according to claim 22, wherein said plural bins and said offset means are arranged for relative movement therebetween in a direction in which the bins are arranged, and said offset means operates to push the sheets on the selected bin each time an alignment is established between said offset means and the selected bin.

* * * * *

UNITED STATES PATENT AND TRADEMARK OFFICE

CERTIFICATE OF CORRECTION

PATENT NO. : 5,434,661

DATED : July 18, 1995

INVENTOR(S) : Yuji Takahashi, et. al.

It is certified that error appears in the above-indentified patent and that said Letters Patent is hereby corrected as shown below:

Column 1

Line 53, "reduced" should read --reduces--.

Column 7

Line 38, "plat" should read --plate--.

Column 8

Line 48, ".same" should read --same--.

Column 9

Line 27, "crated" should read --created--;
Line 53, "s" should read --as--; and
Line 59, "one" should read --on--.

Column 11

Line 3, ",arrow" should read --arrow--.

UNITED STATES PATENT AND TRADEMARK OFFICE

CERTIFICATE OF CORRECTION

PATENT NO. : 5,434,661

DATED : July 18, 1995

INVENTOR(S) : Yuji Takahashi, et. al.

It is certified that error appears in the above-indentified patent and that said Letters Patent is hereby corrected as shown below:

Column 13

Line 25, "lap" should read --up--."

Column 16

Line 44, "having," should read --having--.

Signed and Sealed this

Twenty-fourth Day of October, 1995

Bruce Lehman

*Attest:*

BRUCE LEHMAN

*Attesting Officer*

*Commissioner of Patents and Trademarks*